US007303470B2

(12) United States Patent
George et al.

(10) Patent No.: US 7,303,470 B2
(45) Date of Patent: Dec. 4, 2007

(54) SYSTEM AND METHOD FOR ASSIGNING A VOUCHER TO A PLAYER IN A PLAYER TRACKING SYSTEM

(75) Inventors: Jeffrey George, North Las Vegas, NV (US); Zhiguo Huang, Henderson, NV (US); Doug Huber, Louisville, KY (US); John-Paul Pochin, Christchurch (NZ)

(73) Assignee: Konami Gaming, Inc., Las Vegas, NV (US)

( * ) Notice: Subject to any disclaimer, the term of this patent is extended or adjusted under 35 U.S.C. 154(b) by 842 days.

(21) Appl. No.: 10/661,390

(22) Filed: Sep. 12, 2003

(65) Prior Publication Data

US 2004/0132531 A1 Jul. 8, 2004

Related U.S. Application Data

(63) Continuation-in-part of application No. 09/967,571, filed on Sep. 28, 2001, now abandoned.

(60) Provisional application No. 60/502,179, filed on Sep. 11, 2003.

(51) Int. Cl.
*A63F 9/24* (2006.01)

(52) U.S. Cl. ..... 463/25; 463/42

(58) Field of Classification Search ..... 463/39, 463/40, 41, 42, 43, 25, 29
See application file for complete search history.

(56) References Cited

U.S. PATENT DOCUMENTS 4,283,709 A 8/1981 Lucero et al.
4,339,798 A 7/1982 Hedges et al.
4,636,951 A 1/1987 Harlick
4,764,666 A 8/1988 Bergeron
4,782,468 A 11/1988 Jones et al.
4,948,138 A 8/1990 Pease et al.
5,038,022 A 8/1991 Lucero
5,116,055 A 5/1992 Tracy
5,133,076 A 7/1992 Hawkins et al.
5,249,800 A 10/1993 Hilgendorf et al.
5,265,874 A 11/1993 Dickinson et al.
5,280,909 A 1/1994 Tracy
5,321,241 A 6/1994 Craine
5,332,076 A 7/1994 Ziegert
5,342,047 A 8/1994 Heidel et al.
5,457,306 A 10/1995 Lucero
5,470,079 A 11/1995 LeStrange et al.
5,472,194 A 12/1995 Breeding et al.

(Continued)

OTHER PUBLICATIONS

IBM Technical Disclosure Bulletin, "Abstraction of Remote Operating Systems," Aug. 1, 2001, UK, Issue 448, p. 1374, NNRD44898.

(Continued)

*Primary Examiner*—Robert E Pezzuto
(74) *Attorney, Agent, or Firm*—Howard & Howard Attorneys, P.C.

(57) ABSTRACT

A remote system for use with a gaming system implements a player tracking system. The remote system includes a remote device and a remote network interface coupled to the remote device for exchanging data between a host computer and the remote device. The data includes voucher information to issue a voucher to the player in the player tracking system. The voucher includes at least one of an associated product and service.

49 Claims, 24 Drawing Sheets

U.S. PATENT DOCUMENTS 5,547,202 A 8/1996 Tsumura
5,559,312 A 9/1996 Lucero
5,564,700 A 10/1996 Celona
5,586,937 A 12/1996 Menashe
5,598,572 A 1/1997 Tanikoshi et al.
5,611,730 A 3/1997 Weiss
5,613,912 A 3/1997 Slater
5,655,961 A 8/1997 Acres et al.
5,655,966 A 8/1997 Werdin, Jr. et al.
5,674,128 A 10/1997 Holch et al.
5,702,304 A 12/1997 Acres et al.
5,707,287 A 1/1998 McCrea, Jr.
5,735,525 A 4/1998 McCrea, Jr.
5,741,183 A 4/1998 Acres et al.
5,752,882 A 5/1998 Acres et al.
5,762,552 A 6/1998 Vuong et al.
5,766,076 A 6/1998 Pease et al.
5,770,533 A 6/1998 Franchi
5,797,796 A 8/1998 Dickinson
5,800,268 A 9/1998 Molnick
5,800,269 A 9/1998 Holch et al.
5,804,803 A 9/1998 Cragun et al.
5,811,772 A 9/1998 Lucero
5,819,901 A 10/1998 Filiberti
5,820,459 A 10/1998 Acres et al.
5,833,540 A 11/1998 Miodunski et al.
5,836,817 A 11/1998 Acres et al.
5,851,149 A 12/1998 Xidos
5,855,515 A 1/1999 Pease et al.
5,867,688 A 2/1999 Simmon et al.
5,876,284 A 3/1999 Acres et al.
5,885,158 A 3/1999 Torango et al.
5,902,983 A 5/1999 Crevelt et al.
5,911,626 A 6/1999 McCrea, Jr.
5,919,091 A 7/1999 Bell et al.
5,935,004 A 8/1999 Tarr et al.
5,944,608 A 8/1999 Reed et al.
5,952,640 A 9/1999 Lucero
5,959,277 A 9/1999 Lucero
5,967,896 A 10/1999 Jorasch et al.
5,984,786 A 11/1999 Ehrman
6,001,016 A 12/1999 Walker et al.
6,012,984 A 1/2000 Roseman
6,019,283 A 2/2000 Lucero
6,024,641 A 2/2000 Sarno
6,039,648 A 3/2000 Guinn et al.
6,048,269 A 4/2000 Burns et al.
6,068,552 A 5/2000 Walker et al.
6,071,190 A 6/2000 Weiss et al.
6,077,162 A 6/2000 Weiss
6,080,062 A 6/2000 Olson
6,089,982 A 7/2000 Holch et al.
6,093,103 A 7/2000 McCrea, Jr.
6,110,043 A 8/2000 Olsen
6,110,044 A 8/2000 Stern
6,113,495 A 9/2000 Walker et al.
6,117,011 A 9/2000 Lvov
6,117,012 A 9/2000 McCrea, Jr.
6,126,546 A 10/2000 Reed et al.
6,146,273 A 11/2000 Olsen
6,154,738 A 11/2000 Call
6,162,122 A 12/2000 Acres et al.
6,183,362 B1 2/2001 Boushy
6,183,366 B1 2/2001 Goldberg et al.
6,203,010 B1 3/2001 Jorasch et al.
6,206,782 B1 3/2001 Walker et al.
6,210,275 B1 4/2001 Olsen
6,210,277 B1 4/2001 Stefan
6,240,444 B1 5/2001 Fin et al.
6,267,671 B1 7/2001 Hogan
6,302,793 B1 10/2001 Fertitta, III et al.
6,435,968 B1 8/2002 Torango
6,582,310 B1 6/2003 Walker et al.
6,592,460 B2 7/2003 Torango
6,633,914 B1 10/2003 Baych et al.
6,645,077 B2 11/2003 Rowe
6,650,346 B1 11/2003 Jaeger et al.
6,681,984 B2 1/2004 Brunner
6,682,421 B1 1/2004 Rowe et al.
6,712,695 B2 3/2004 Mothwurf et al.
6,712,698 B2 3/2004 Paulsen et al.
6,763,998 B1 7/2004 Miodunski et al.
6,800,029 B2 10/2004 Rowe et al.
6,830,515 B2 12/2004 Rowe
6,962,531 B2 11/2005 Pace et al.
2001/0003100 A1 6/2001 Yacenda
2001/0029528 A1 10/2001 Coutts et al.
2001/0036857 A1 11/2001 Mothwurf et al.
2001/0036858 A1 11/2001 McNutt et al.
2001/0056386 A1 12/2001 O'Halloran et al.
2002/0002075 A1 1/2002 Rowe
2002/0042297 A1 4/2002 Torango
2002/0058550 A1 5/2002 Pace et al.
2002/0094869 A1 7/2002 Harkham
2002/0107715 A1 8/2002 Pace et al.
2002/0142825 A1 10/2002 Lark et al.
2002/0142846 A1 10/2002 Paulsen
2002/0155887 A1 10/2002 Criss-Puszkiewicz et al.
2002/0165023 A1 11/2002 Brosnan et al.
2002/0173354 A1 11/2002 Winans et al.
2002/0177483 A1 11/2002 Cannon
2003/0023516 A1 1/2003 Sharrow et al.
2003/0028480 A1 2/2003 Rowe
2003/0054868 A1 3/2003 Paulsent et al.
2003/0054878 A1 3/2003 Benoy et al.
2003/0054881 A1 3/2003 Hedrick et al.
2003/0055948 A1 3/2003 Wang
2003/0057269 A1 3/2003 Brunner
2003/0064805 A1 4/2003 Wells
2003/0092477 A1 5/2003 Luciano, Jr. et al.
2004/0002386 A1 1/2004 Wolfe et al.
2004/0127277 A1 7/2004 Walker et al.
2004/0209692 A1 10/2004 Schober et al.
2004/0229683 A1 11/2004 Mothwurf et al.
2005/0070356 A1 3/2005 Mothwurf et al.
2005/0150946 A1 7/2005 Miodunski et al.

OTHER PUBLICATIONS

Webopedia definitions for CGI and servlet, downloaded from www.webopedia.com, Dec. 12, 2006.
Wikipedia articles for Common Gateway Interface, PHP, and Java Servlet, downloaded from www.wikipedia.org, May 22, 2006.
Surveillance Remote Network Interface, origin unknown, 1 page (1059).
Bottoms Up, Murphy's Back, New York Times, Thursday, Oct. 26, 2000, p. B11.
Ramakrishnan, Raghu. Database Management Systems, 1998. WCB McGraw-Hill. pp. 21-22.
U.S. Appl. No. 10/661,392, filed Sep. 12, 2003; Applicant: Jeffrey George; "System and method for enrolling a player in a player tracking system".
U.S. Appl. No. 10/661,140, filed Sep. 12, 2003; Applicant: Jeffrey George; "System and method for retrieving player attendance information in a gaming system".
U.S. Appl. No. 10/660,959, filed Sep. 12, 2003; Applicant: Jeffrey George; "System and method for processing a hopper fill in a gaming system".
U.S. Appl. No. 10/661,450, filed Sep. 12, 2003; Applicant: Jeffrey George; "System and method for retrieving remote device information".
U.S. Appl. No. 10/661,395, filed Sep. 12, 2003; Applicant: Jeffrey George; "System and method for processing a cash ticket in a gaming system".

U.S. Appl. No. 10/661,145, filed Sep. 12, 2003; Applicant: Jeffrey George; "System and method for processing an alert in a gaming system".

U.S. Appl. No. 10/661,391, filed Sep. 12, 2003; Applicant: Jeffrey George; "System and method for processing a table rating for a player".

U.S. Appl. No. 10/661,131, filed Sep. 12, 2003; Applicant: Jeffrey George; "System and method for retrieving player information in a player tracking system".

U.S. Appl. No. 10/662,101, filed Sep. 12, 2003; Applicant: Jeffrey George; "System and method for adjusting points assigned to a player tracking system".

U.S. Appl. No. 10/661,865, filed Sep. 12, 2003; Applicant: Jeffrey George; "System and method for redemption of printed vouchers".

U.S. Appl. No. 10/661,133, filed Sep. 12, 2003; Applicant: Jeffrey George; "System and method for processing a jackpot in a gaming system".

U.S. Appl. No. 10/661,129; filed Sep. 12, 2003; Applicant: Jeffrey George; "System and method for retrieving device information".

U.S. Appl. No. 10/661,233; filed Sep. 22, 2003; Applicant: Jeffrey George; "System and method for retrieving voucher information assigned to a player in a player tracking system".

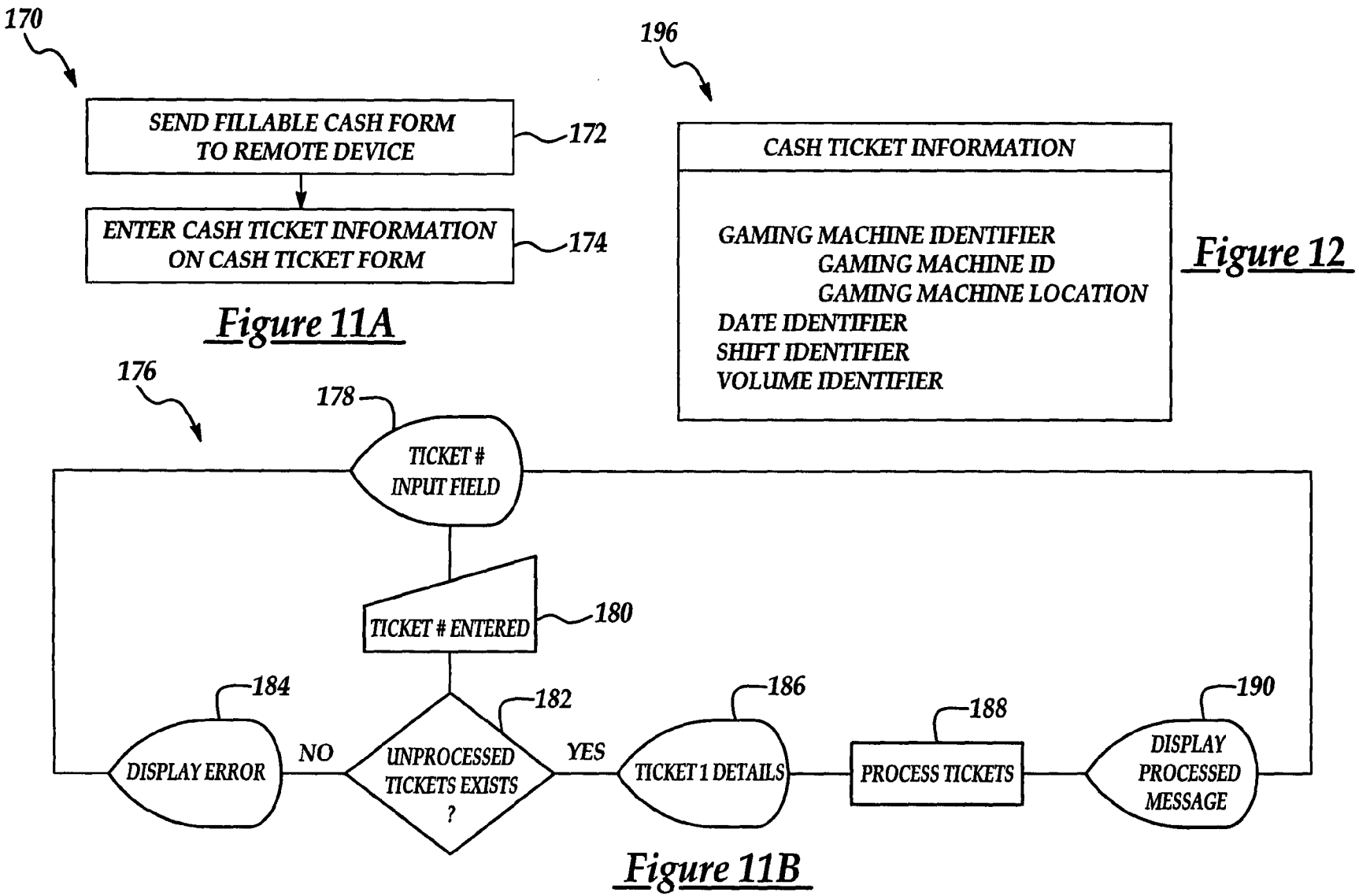
170
SEND FILLABLE CASH FORM TO REMOTE DEVICE
172
ENTER CASH TICKET INFORMATION ON CASH TICKET FORM
174
Figure 11A
196
CASH TICKET INFORMATION
GAMING MACHINE IDENTIFIER
GAMING MACHINE ID
GAMING MACHINE LOCATION
DATE IDENTIFIER
SHIFT IDENTIFIER
VOLUME IDENTIFIER
Figure 12
176
178
TICKET # INPUT FIELD
180
TICKET # ENTERED
182
UNPROCESSED TICKETS EXISTS ?
YES
NO
184
DISPLAY ERROR
186
TICKET 1 DETAILS
188
PROCESS TICKETS
190
DISPLAY PROCESSED MESSAGE
Figure 11B

SYSTEM AND METHOD FOR ASSIGNING A VOUCHER TO A PLAYER IN A PLAYER TRACKING SYSTEM

CROSS-REFERENCE TO RELATED APPLICATIONS

The present application claims priority to U.S. Provisional Application Ser. No. 60/502,179, filed Sep. 11, 2003 and is a continuation-in-part application of U.S. patent application Ser. No. 09/967,571, filed Sep. 28, 2001 now abandoned.

FIELD OF THE INVENTION

The present invention relates generally to gaming machines, and more particularly, to a system and method for remotely accessing the player tracking system.

BACKGROUND OF THE INVENTION

The growth and competition in the casino gaming market in recent years and the increasingly sophisticated and complex technology being integrated into the gaming environment, at the individual game, casino management, and auditing levels, presents both challenges and opportunities to game manufacturers, gaming establishment operators, and regulatory agencies. The technological capabilities and requirements of, for example, advanced electronic games, multi-site gaming operations, detailed player tracking, wide area progressive jackpots, and various alternatives to the use of currency and coins by players, all present a potentially huge pool of ever-changing data which can be of great value to casino operators (from a management standpoint) and to regulators from an audit/compliance standpoint.

Players may also be given an incentive through a player tracking club. Usually, a player is identified during play by a player tracking ID card and/or a player identification number (PIN). The player tracking system tracks the player's play and awards player tracking points according to established criteria. The player tracking points may be redeemed for prizes, such as complimentary meals or merchandise.

Typically, the player tracking system is accessed at workstation or computers which are linked to a remote server. The computer applications which are used to access the player tracking system for various functions are stored on the workstation.

However, these types systems are inflexible and do not provide the casino operator with the maximum benefit and advantages available from the information and systems now available.

The present invention is aimed at one or more of the problems as set forth above.

SUMMARY OF THE INVENTION

In one aspect of the present invention, a remote system for use with a gaming system is provided. The gaming system implements a player tracking system. The system includes a remote device and remote network interface coupled to the remote device for exchanging data between a host computer and the remote device. The data includes voucher information to issue a voucher to the player in the player tracking system. The voucher has at least one of an associated product and service.

In another aspect of the present invention, a method for implementing the player tracking system for use with a gaming system is provided. The method includes the steps of sending a fillable form to a remote device and filling out the form with data by a user on the remote device for issuing a voucher to the player in the player tracking system. The voucher has at least one of an associated service and product.

BRIEF DESCRIPTION OF THE DRAWINGS

Other advantages of the present invention will be readily appreciated as the same becomes better understood by reference to the following detailed description when considered in connection with the accompanying drawings wherein:

FIG. 11A is a first flow diagram of a method for remotely processing jackpot tickets, according to an embodiment of the present invention;

FIG. 11B is a second flow diagram of a method for remotely processing jackpot tickets, according to a second embodiment of the present invention;

FIG. 12 is a diagrammatic illustration of a cash ticket information screen, according to an embodiment of the present invention;

DETAILED DESCRIPTION OF INVENTION

I. Overview

With reference to the drawings and in operation, the present invention provides a system 10 and methods related to a player tracking method or to one or more gaming devices 12.

The gaming devices 12 may be electronic or electric gaming machines 13, such as slot or video slot machines, poker or video poker machines, arcade or video arcade games, and the like, but may also include other types of devices 12A connected to the system 10, such as virtual gaming machines (for online gaming), electronic interfaces for use with table games, vending machines, token or credit dispensing machines, ticket redemption machines, or any other electric or electronic device connected to the network.

II. The Gaming System

Figure 1:
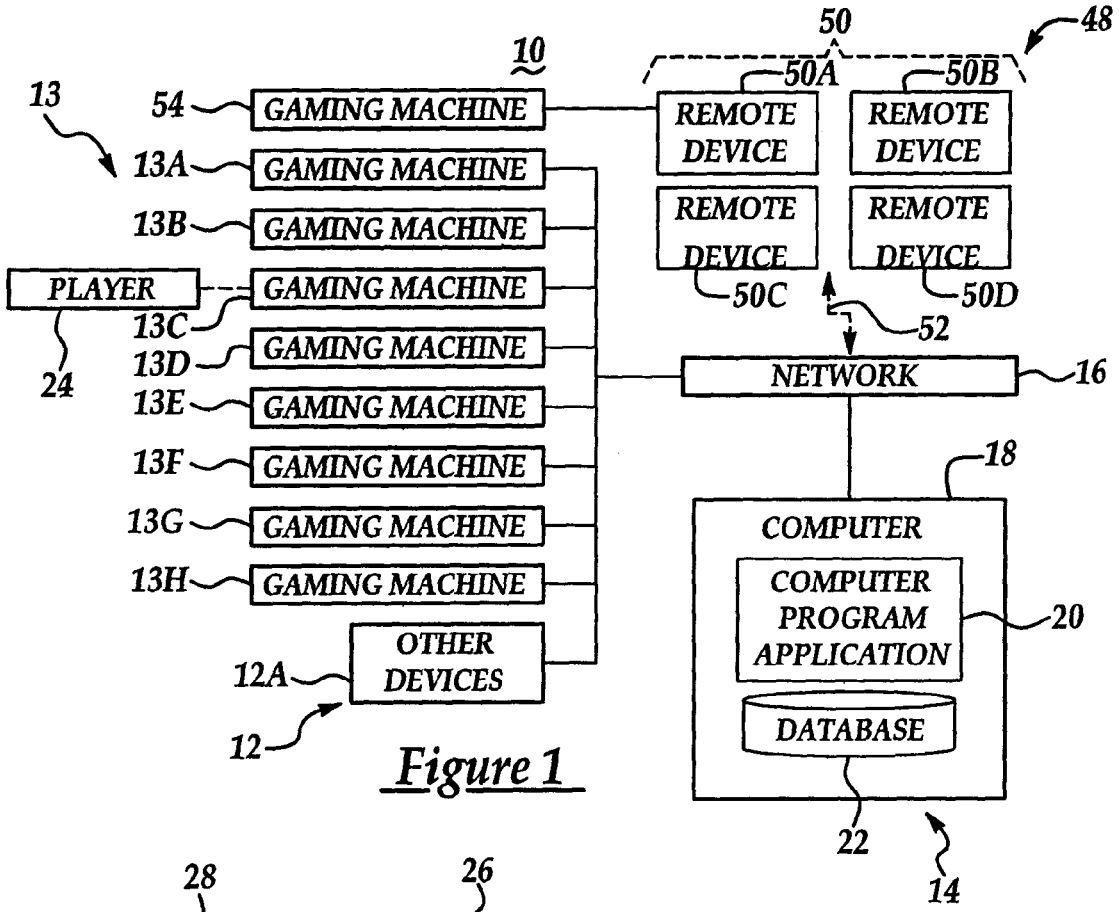
FIG. 1 is a block diagram of a remote system for use with a gaming system, according to an embodiment of the present invention.

In one embodiment, the system 10 and methods may be embodied or implemented via an entertaining management and monitoring system or gaming system 14 which is shown in block diagram form in FIG. 1. The entertainment and monitoring system 14 may include may additional functions such as, real-time multi-site, slot accounting, player tracking, cage credit and vault, sports book data collection, Point of Sale (POS) accounting, keno accounting, bingo accounting, and table game accounting, a wide area progressive jackpot, and electronic funds transfer (EFT). Two exemplary systems are disclosed in U.S. patent application Ser. No. 09/967,571, filed Sep. 28, 2001, and U.S. Provisional Patent Application Serial (Not Assigned), filed Sep. 11, 2003 both of which are hereby incorporated by reference.

In the illustrated embodiment, the system 10 includes eight electronic gaming machines 13A-13H. However, it should be noted that the present invention is not limited to any number of devices 12 or machines 13. In one embodiment, the machines 13 are organized into banks (not shown), each bank containing a plurality of machines 13.

The gaming devices 12 are connected via a network 16 to one or more host computers 18, which are generally located at a remote or central location. The computer 18 includes a computer program application 20 which maintains one or more databases 22. In one embodiment, the database(s) are Oracle database(s).

The computer program application 20 and databases 22 may be used to record, track, and report accounting information regarding the gaming devices 12 and/or users of the gaming devices 12 or players of the electronic gaming machines 13. Additionally, the computer program application 20 and databases 22 may be used to maintain information related to player tracking accounts (see below).

In general, the electronic gaming machines 13 are playable by a player 24. The player 24 may select one of the electronic gaming machines 13C to play and insert a coin, credit, coupon, and/or player tracking card (not shown) into the chosen gaming machine 13C. Generally, the electronic gaming machines 13C have an associated number of credits or coins required in order to play. In the case of video slot or poker games, the game is played and an award in the form of credits may be awarded based on a pay table of the gaming machine 13.

Figure 2:
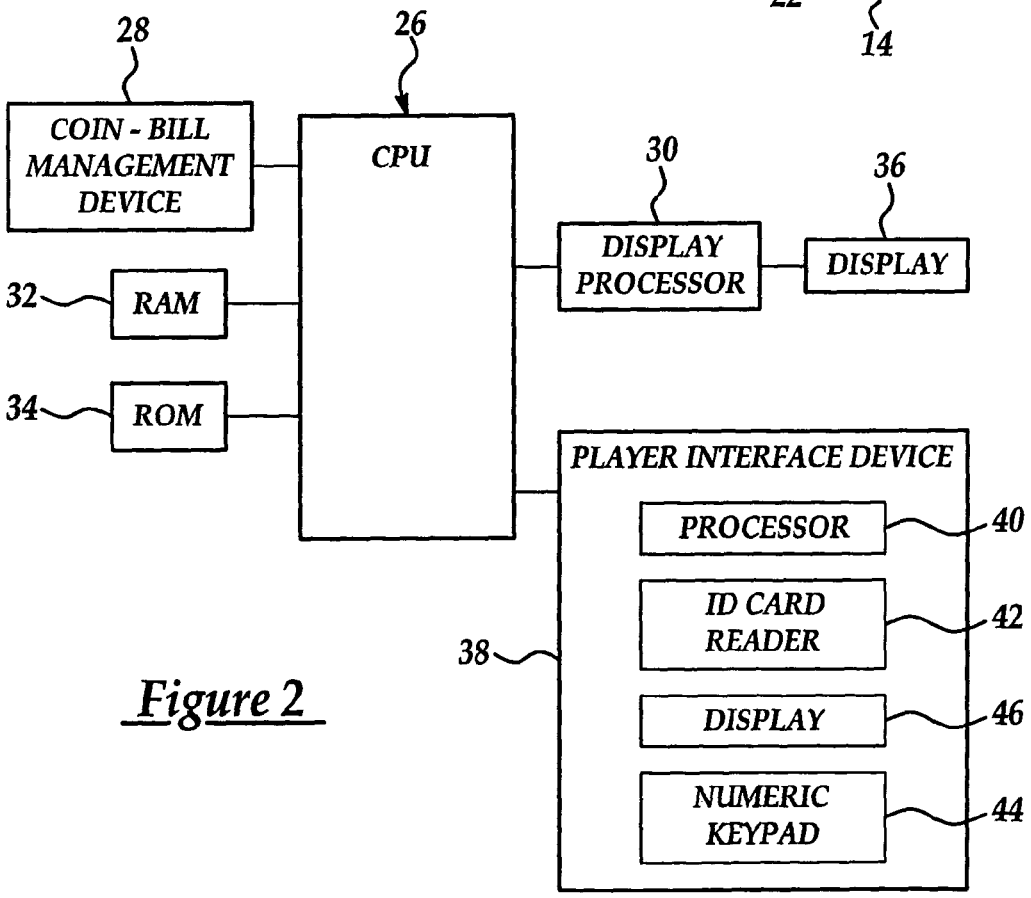
FIG. 2 is block diagram of an gaming machine and a remote device, according to an embodiment of the present invention.

With reference to FIG. 2, a block diagram of a suitable electronic gaming machine 13C is shown.

The machine 13C comprises a game controller 26, or central processing unit (CPU), a coin-bill management device 28, a display processor 30, a RAM 32 as a memory device and a ROM 34 (generally provided as an EPROM). The CPU 26 is mainly composed of a microprocessor unit and performs various calculations and motion control necessary for the progress of the game. The coin-bill management device 28 detects the insertion of a coin or a bill and performs a necessary process for managing the coin and the bill. The display processor 30 interprets commands issued from the CPU 26 and displays desirable images on a display 36. The RAM 32 temporarily stores programs and data necessary for the progress of the game, and the ROM 34 stores, in advance, programs and data for controlling basic operation of the machine 12C, such as the booting operation thereof, game code and graphics.

Input to the gaming device 12C may be accomplished via mechanical switches or buttons or via a touchscreen interface (not shown). Such gaming machines 12 are well known in the art and are therefore not further discussed.

The player 24 is identified via the player tracking card and/or a player identification number entered into player tracking device 38 at each gaming machine 12 (see below). Player tracking accounts may be used, generally, to provide bonuses to a player, in addition to the award designated by, in the case of a video slot or poker machine, the gaming machine's 12 paytable. These bonuses may be awarded to the player 24 based a set of criteria, including, but not limited to, a) the player's play on the machine 12C, b) the player's overall play, c) play during a predetermined period of time, and d) the player's birthday or anniversary, or e) any other definable criteria. Additionally, bonuses may be awarded on a random basis, i.e., to a randomly chosen player or randomly chosen game 12. Bonuses may also be awarded in a discretionary manner or based on other criteria, such as, purchases made at a gift shop or other affiliated location.

In one embodiment, the player tracking device 38 includes a processor 40, a player identification card reader 42 and/or a numeric keypad 44, and a display 46. In one embodiment, the display 46 is a touchscreen panel and the numeric keypad 44 is implemented thereon.

The player 24 may be identified by entry of a player tracking card into the player identification card reader 42 and/or entry of a player identification number (PIN) on the numeric key pad 46. The play tracking device 38 may also be used to communicate information between the computer 18 and the corresponding gaming machine 12C. The player tracking device 40 may also be used to track bonus points, i.e., incentive points or credits, downloaded from the computer 18.

In one aspect of the present invention, the bonuses are awarded as bonus points. In one embodiment, the bonus points are incentive points. In another embodiment, the bonus points are credits.

The incentive points may converted to credits using a predetermined ratio. The predetermined ratio may be 1 or any other desired ratio. The predetermined ratio may also be varied based on determined criteria, e.g., the gaming machine 12 being played, the player, or the time of day. Incentive points may be designated as cashable or non-cashable. The incentive points in a player account may be downloaded to one of the gaming machines 12 for play.

III. Remote System

Returning to FIG. 1, the present invention provides a remote system 48 for use with the gaming system 14. The remote system 48 provides access to various features or functions of the gaming system 14 by one or more remote devices 50.

In the illustrated embodiment, there are four remote devices 50A, 50B, 50C, 50D, however, this is for discussion purposes only. Any number of remotes devices 50 may be included.

The remote devices 50 are connected to the network 16 through a network link 52. In one aspect of the present invention, the network link 52 is a wireless connection. In one embodiment, the wireless connection uses the IEEE 802.11 standard, e.g., 802.11b or 802.11g. However, it should be noted that wireless links using other standards may also be used where appropriate, such as a short range radio link (e.g., a link using the technology known as "Blue Tooth"). In another aspect of the present invention, the network link 52 may be a wire link.

The remote devices 50 are generally used by a user 54 and provides, as discussed below, access to various data and/or functions of the gaming system 14.

In one aspect, the user 54 is an employee of the gaming established where the gaming system 14 is operating. Typically, the user 54 has an assigned role (or type) based on their job description. Typical roles may include, but are not limited to, system administrator, supervisor, pit, pit manager, slot floor employee, patron host, player's club, security, security supervisor, slot attendant, slot director, slot shift supervisor, slot technician, sports and racebook, surveillance, and table supervisor.

In one embodiment of the present invention, the remote devices 50 provides access to one or more types of data and/or one or more functions based on the assigned role of the user 54. In one embodiment, a remote device 50 may provide access to one or more of the following functions: remote patron signup, remote patron information, remote device information, remote cash ticket processing, remote jackpot ticket processing, remote hopper fill ticket processing, remote table rating interface, remote attendance, remote surveillance, adjusting a player's bonus or comp points, issuing comp vouchers to a player, redeeming printed vouchers, listing and redeeming outstanding vouchers assigned to a player, and retrieving and displaying information related to a specific remote device 50. Each of these functions is described more fully below.

In one embodiment of the present invention, the remote device 50A may be a mobile computer based on the PALM operating system or Microsoft Windows operating system. With specific reference to FIG. 3 in one embodiment of the present invention, the remote device 50A includes a processor 58, a memory 60 for storing applications and data, and a display 64. The display 64 may be a touchscreen display.

The remote device 50A may also include a bar code reader 66. The bar code reader 66 may be used to read a player ID card number from the ID card or to read a device ID number from a device 12 (see below). One such mobile computer is available from Symbol Technologies, Inc. of Holtsville, N.Y. as model number SPT 1800.

Additionally or alternatively, the remote device 50A may include an ID card reader 62 capable of reading magnetic stripe ID cards.

In another embodiment, the remote devices 50 are desktop, laptop, notebook, and/or sub-notebook computers.

Returning to FIG. 3, in one embodiment of the present invention, the remote device 50A includes a web client 56 which is stored in the memory 60 and run on the processor 58. The web client 56 is connected to the computer program application 20 running on the host computer 18 through the network link 52.

In one aspect of the present invention, all interaction with the user, including the display of data and queries and the input of data, is handled by the web client 56. The web client 56 is responsible for acquiring user input, e.g., through forms, and formatting and presenting information to the user 54. The web client 56 is a computer application which is accessed via a web browser, such as Microsoft Internet Explorer, available from Microsoft Corp., of Redmond Calif. The web client 56 may be written in Hypertext Mark-Up Language (HTML) and include one or more servlets (see below) which may be written in a computer programming language, such as Java.

Figure 3:
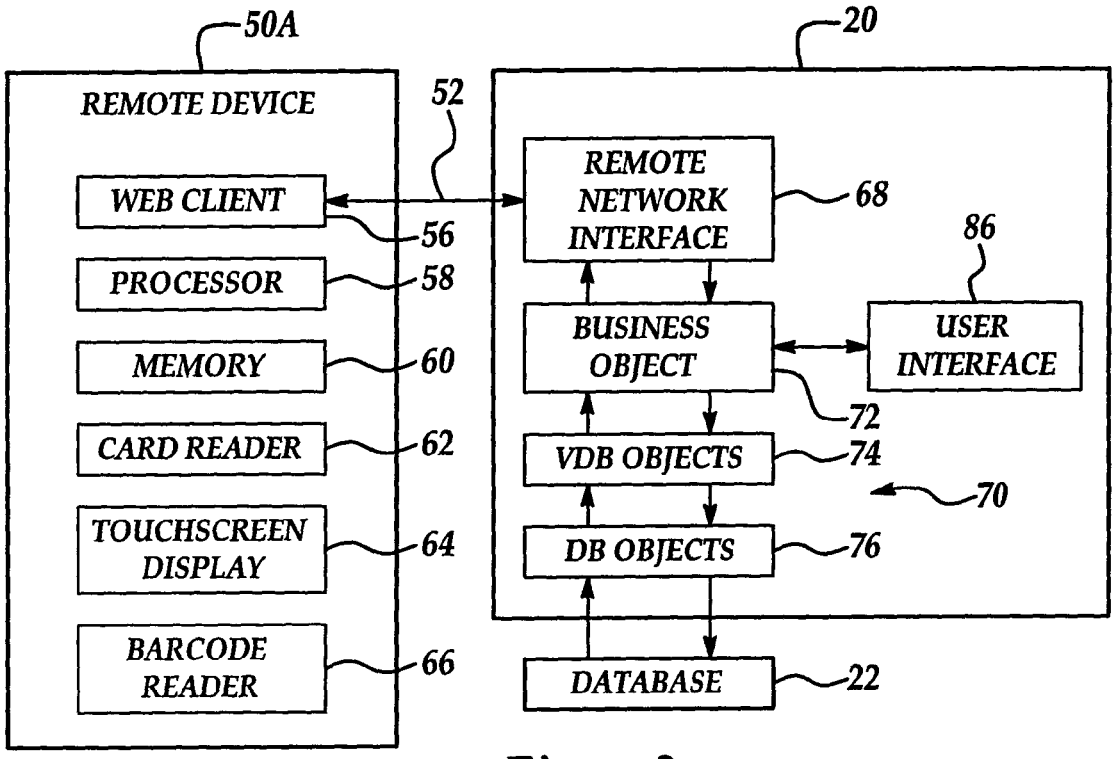
FIG. 3 is a more detailed block diagram of the remote device of FIG. 2 and a computer program application, according to an embodiment of the present invention.

As shown in FIG. 3, the computer program application 20 implements a remote network interface 66. The remote network interface 68 couples the web client 56 with the database 22. In one embodiment, the remote network interface 68 obtains data from the database 22, formats the data, e.g., into an HTML response, and returns the formatted data to the web client 56.

In one aspect of the present invention, the remote network interface 68 is coupled to the database 22 by one or more data objects 70. In one embodiment, data is stored in the database 22 in data tables. The data objects 70 handle requests from the remote network interface 68, abstracts the required data from the database tables and/or sets data into the database tables.

As shown, in FIG. 3, the data objects 70 include a plurality of first data object (DBOBJECTS) 76, at least one second data object (VDBOBJECTS) 74, and a third data object (BUSINESS OBJECT) 72.

The first data objects 76 are coupled to the database tables and abstract specific database tables for the at least one second data object 74. The first data objects 76 handle retrieving and setting data into specific database tables.

The at least one second data object 74 is coupled to the first data objects 76 assemble multiple first data objects 76 into a single third data object 72. The at least one second data object 74 abstract the third data object 72 from the database tables.

The third data object 72 is coupled to the at least one second data object 74. The third data object receives queries from the remote network interface, retrieves responsive data from the database (through the first and second data objects 74,76), formats the responsive data and returns the responsive data to the remote network interface.

Figure 4:
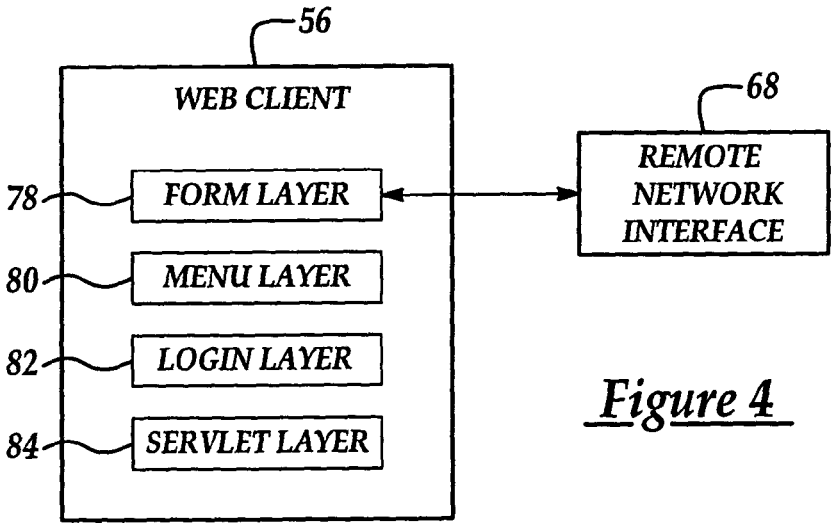
FIG. 4 is a block diagram of a web client operating on the remote device of FIG. 2, according to an embodiment of the present invention.

With reference to FIG. 4 in one embodiment, the web client 56 is written in HTML. In the illustrated embodiment, the web client 56 includes a form layer 78, a menu layer 80, a login layer 82, and a servlet layer 84.

The login layer 82 provides security. It allows the user 54 to logon to the remote system 48. In one embodiment, the user 54 enters a name and password to logon. The user 54 may also be required to enter or select the site at which the user 54 is located.

The menu layer 90 allows the user 54, once logged on, to navigate to and between servlets. The servlets are downloaded to the remote device 50 from the hose computer 18 as needed. The menu layer 90 also handles providing access to those servlets to which the user 54 has access, typically based on an assigned role (see above).

The form and servlet layers 78, 84 provides common functionality for the servlets.

A. Remote Player or Patron Signup

Figure 5A:
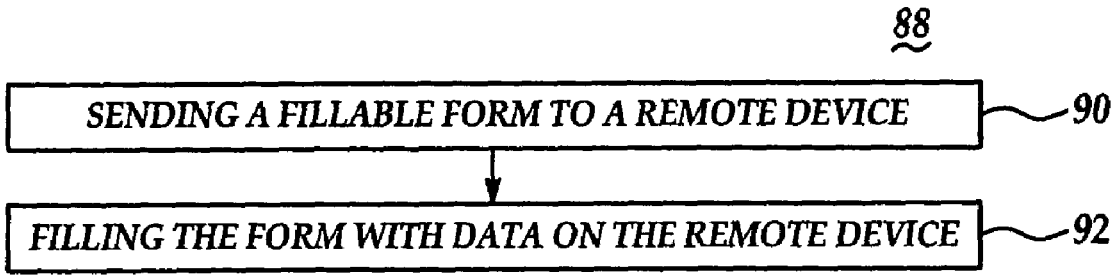
FIG. 5A is a first flow diagram of a method for enrolling a player in a player tracking system, according to an embodiment of the present invention.
Figure 6:
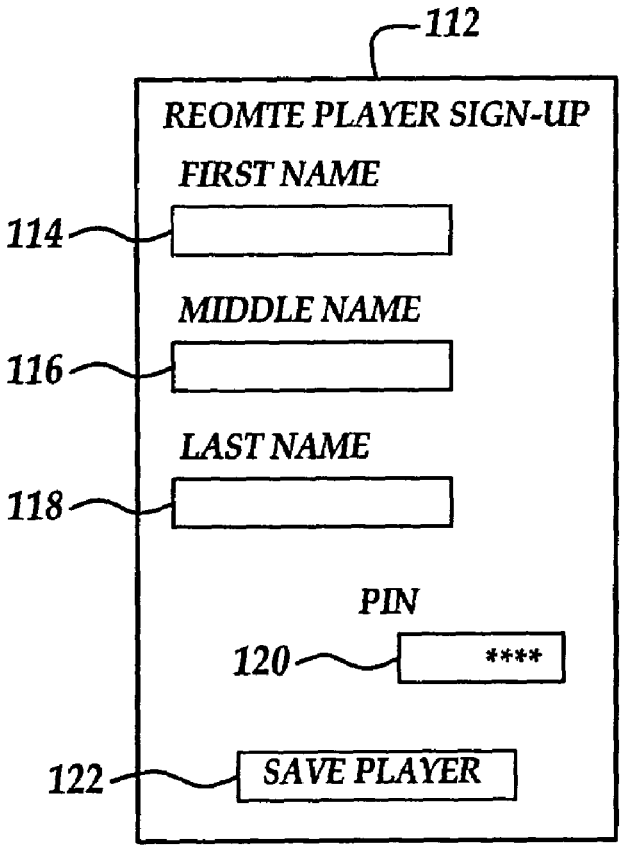
FIG. 6 is a diagrammatic illustration of a remote player signup form according to an embodiment of the present invention.
Figure 5B:
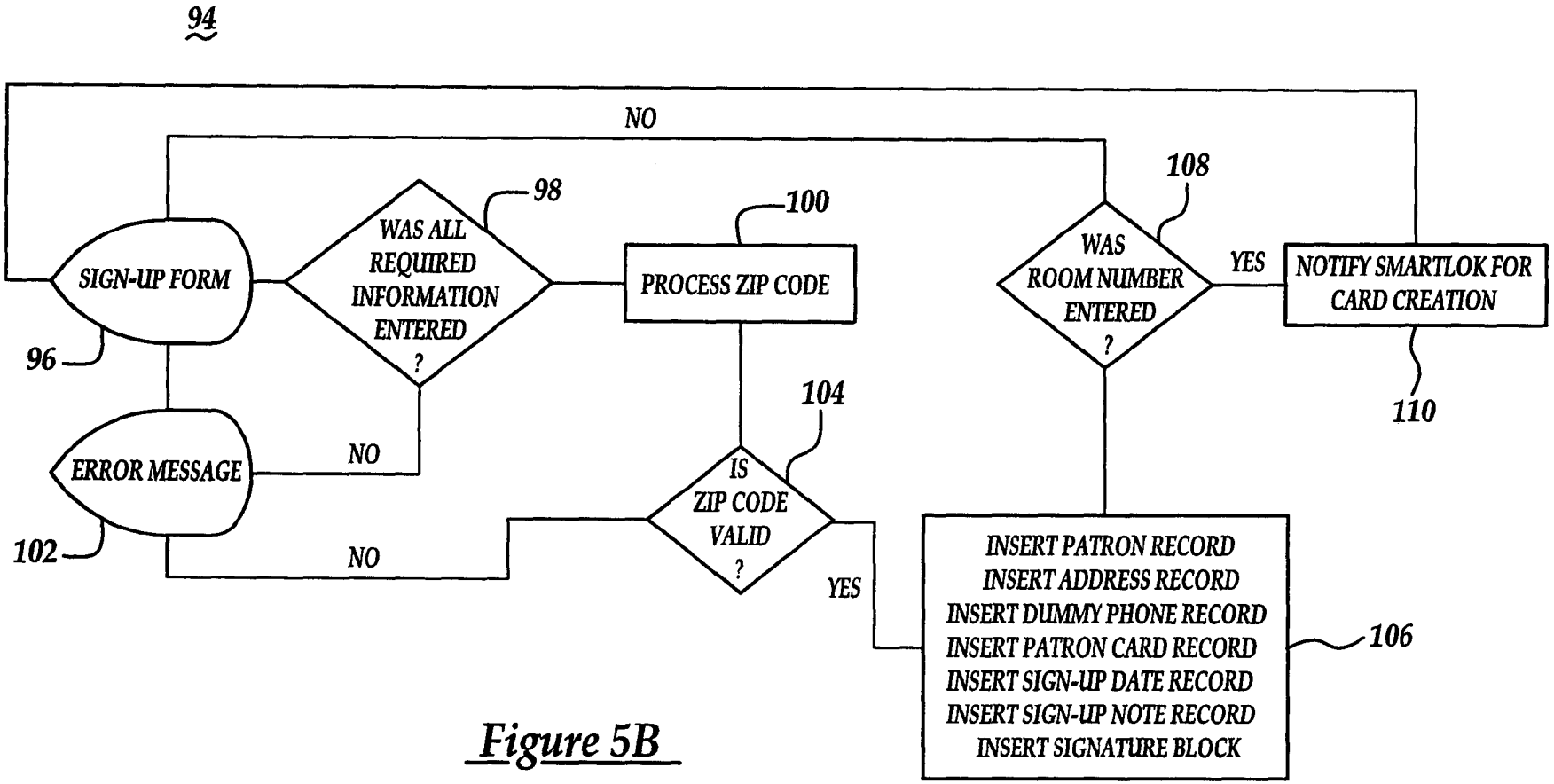
FIG. 5B is a second flow diagram of a method for enrolling a player in a player tracking system, according to a second embodiment of the present invention.

With reference to FIGS. 5A, 5B, and 6, the remote system 48 allows the user 54, such as a slot floor employee or patron host to quickly and remotely enroll a player or patron in the player tracking system. The user 54 will generally have a number of unassigned player ID cards (not shown). The user 54 may be approached by a player 24 who requests to enroll or may approach the player 24 and ask if they would want to enroll.

If the player 24 wants to enroll, the user 54 enters sign-up information or data onto the remote device 50A and gives the player 24 a player ID card. The sign-up information is sent by the remote device 50A to the host computer 18 and stored in the database 22 along with the ID card number of the assigned player ID card.

In one embodiment, the user 54 navigates to a servlet for enrolling the player 24 using the menu layer 80. The menu layer 80 requests the servlet from the host computer 18 from which it is then downloaded to the remote device 50A.

In one embodiment, only the player's name and a player identification number (PIN) is required. The player identification number may be selected by the player 24 or be a temporary default PIN assigned to the player ID card. The player ID card number to be assigned to the player 24 may be read by the ID card reader 62 or the barcode reader 66, as appropriate.

When the user 54 selected enrollment from the menu layer, the web client 56 relays the request to the remote network interface 68. The remote network interface 68 retrieves a signup form and sends the signup form to the remote device 50A for display and interaction with the user 54 via the web client 56.

With specific reference to FIG. 5A, a first method 88 for enrolling the player 24 in the player tracking system using the remote device 50A, according to a first embodiment of the present invention is shown. In a first step 90, a fillable signup form is sent to the remote device 50A. In a second step 92, the player information (or enrollment data) is entered on the signup form via the remote device 50A.

With specific reference to FIG. 5B, a second method 94 for enrolling the player 24 in the player tracking system using the remote device 50A, according to a second embodiment of the present invention is shown.

In a first step 96, the signup form is displayed on the remote device 50A. In a step 98, if all required information, e.g., a zip code, was entered then the method 94 proceeds to a third step 100. If all required information was not entered, then an error message is displayed in a fourth step 102 and the process returns to the first step 96.

In the third step 100, the zip code is processed, i.e., the corresponding city and state are determined. In a fifth step 104, if the zip code is not valid, then the method 94 displays an error message (fourth step 102). If the zip code is valid, then the method 94 proceeds to a sixth step 106.

In the sixth step 106, the enrollment data is stored are stored as records in the database 22 and control proceeds to a seventh step 108. In the seventh step 108, if a room number, i.e., the hotel room hotel in which the player 24 is residing was entered, then the process proceeds to an eighth step 110. Otherwise, the method 96 returns to the first step 96.

In the eighth step 110, an external system (not shown), may be notified for the creation of room lock keys. One such system In one embodiment as discussed below, the room lock keys may be used for the player tracking system and/or room locks.

An exemplary signup form 110, displayed on the remote device 50A by the web client 56 is shown in FIG. 6. As discussed above, in one embodiment the only information required is the player's name and a PIN number. The exemplary signup form 110 includes an entry box for the player's first, middle, and last names 112, 114, 116 and a PIN entry box 118. After the required information has been entered, the user 54 selects a save player button 120 to send the data to the host computer 18.

In another embodiment, the signup form 110 requires additional information. The additional information may include, but is not limited to the following: player ID card number (from pre-printed card or left blank for system generated card), address, zip code, country, telephone number(s), room number, number of adult cards, number of child cards, signup date, and one or more notes. Child cards operate only the lock of a hotel room. Adult cards work in the player tracking system and operate the room lock.

Additionally as discussed above, the display 46 is a touchscreen display. In one embodiment, the display may capture a signature of the player 24. The player's signature may be also be sent to the host computer 18 with the enrollment data and stored in the database 22.

B. Remote Patron Information

Figure 7A:
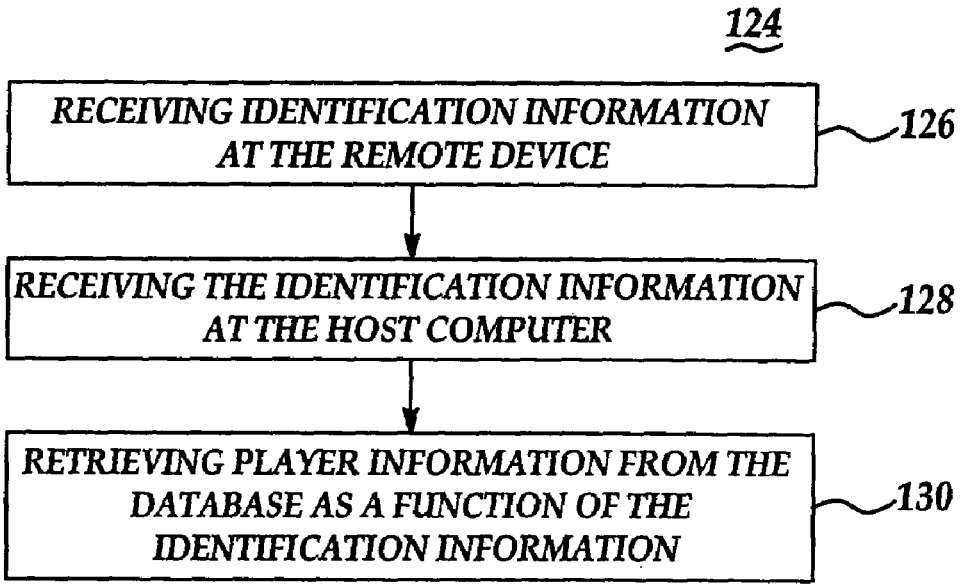
FIG. 7A is a first flow diagram of a method for remotely accessing player information, according to an embodiment of the present invention.
Figure 8:
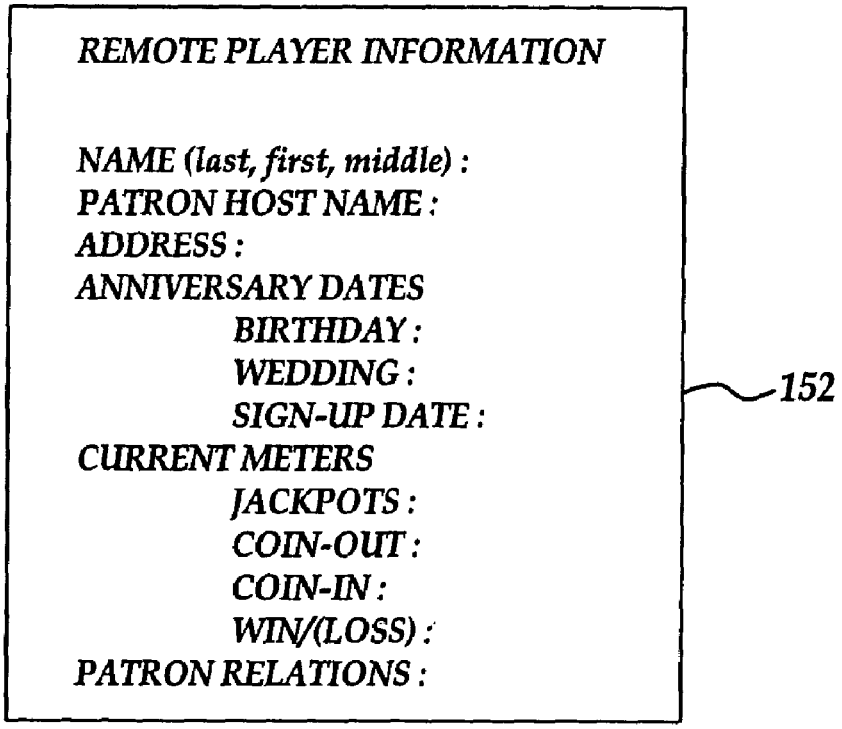
FIG. 8 is a diagrammatic illustration of a remote player information screen, according to an embodiment of the present invention.
Figure 7B:
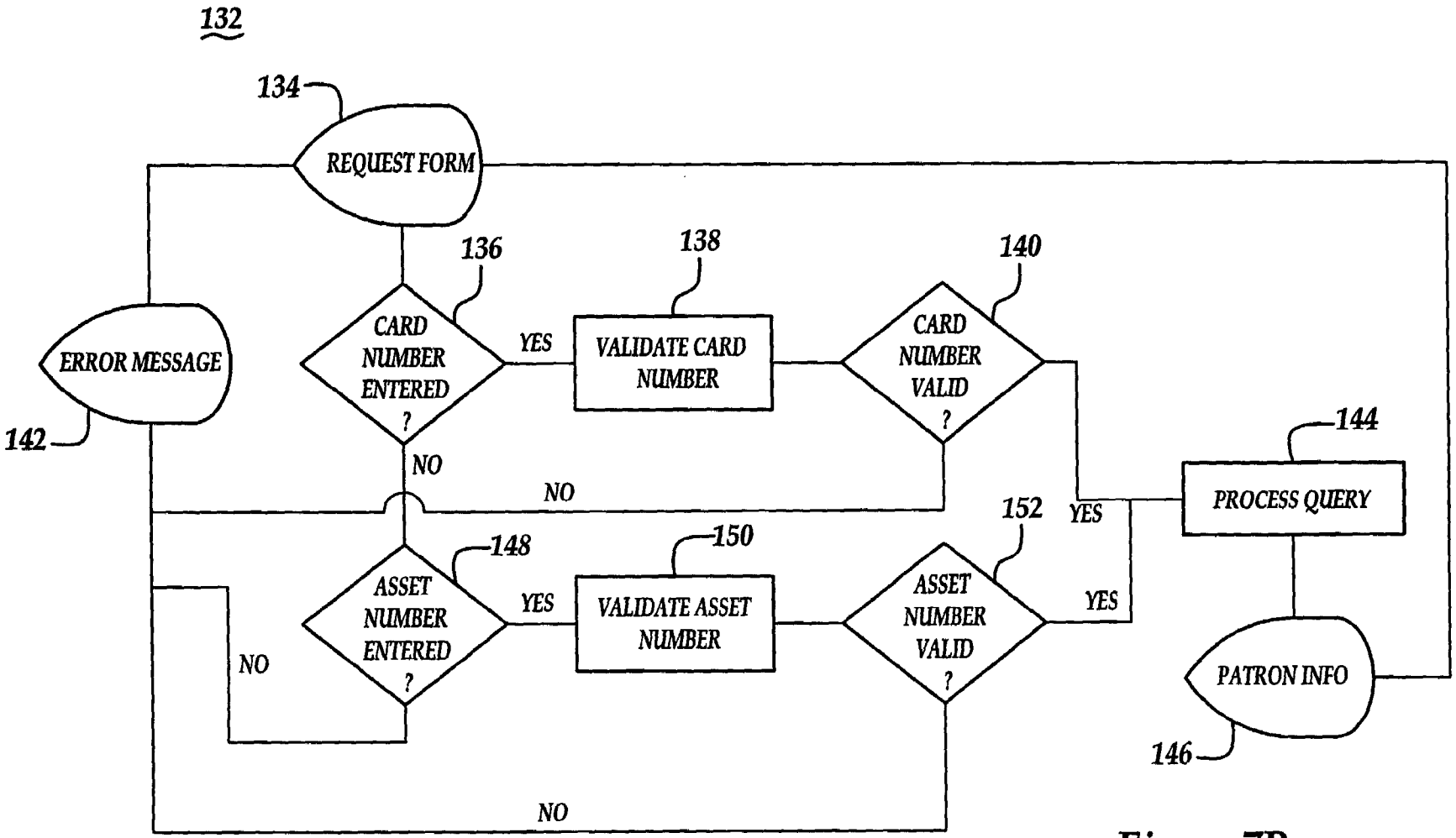
FIG. 7B is a second flow diagram of a method for remotely accessing player information, according to a second embodiment of the present invention.

With reference to FIGS. 7A, 7B, and 8, the remote system 48 allows the user 54, such as a slot floor employee or patron host to quickly and remotely request and receive player information related to a specific player 24. This may be done prior to approaching the player 24 who is using a specification gaming machine 13 or after the user 54 has been approached by the player 24.

In the illustrated embodiment, interaction with the user 54, including receiving input and displaying the player information, is accomplished using the web client 56.

In one aspect of the present invention, the user 54 may identify the player 24 through entry of the player's ID card number into the remote device 50A. In one embodiment, the ID card number may be entered manually. In another embodiment, the ID card number may be read from the player's ID card using the card reader 62 or the barcode reader 66 as appropriate.

In another aspect of the present invention, if the player 24 is utilizing one of the devices 12 and has identified themselves to the player tracking system by entry of the ID card into the device 12 and/or entered in their PIN number, the user 54 may identify the player 24 by entered a device ID number associated with the respective device 12. As discussed below, the player tracking system has associated the ID number of the device 12 with the player 24 while the player 24 is using the device 12. Thus, using the device ID number, the host computer 18 may determine the ID number of the player 24.

In one embodiment, the user 54 navigates to a servlet for requesting player information using the menu layer 80. The menu layer 80 requests the servlet from the host computer 18 from which it is then downloaded to the remote device 50A.

The servlet displays a request form which is displayed to the user 54. As discussed above, the user 54 may either enter the player ID card number of the player 24 (manually or reading it from the ID card) or a device ID number associated with a device 12 being used by the player 24. The user 54 enters identification information (in the form of the player ID card number or the device ID number) which is returned to the host computer 18 by the web client 56. The remote network interface 68 receives the identification information, retrieves the player information and returns the player information to the remote device 50A where it is displayed.

With specific reference to FIG. 7A, a first method 124 for remotely requesting information relating to a player 24 is provided. In a first step 126, identification information is received at the remote device. In a second step 128, the identification information is received at the host computer. In a third step 130, the player information is retrieved from the database 22 as a function of the identification information.

With specific reference to FIG. 7B, a second method 132 for remotely requesting player information using the remote device 50A is shown, according to a second embodiment of the present invention.

In a first step 134, the request form is displayed on the remote device 50A. In a second step 136, if a player ID card number has been entered, then the method 132 proceeds to a third step 138. In the third step 138, the ID card number is validated. In a fourth step 140, if the ID card number is not valid, an error message is displayed in a fifth step 142. If the ID card number is valid, then the message proceeds to a sixth step 144.

In the sixth step 144, the query (request for player information) is processed by the host computer 18. The player (or patron) information is then returned to the remote device 50A to be displayed in an seventh step 146.

In the second step 136, if an ID card number has not been entered, then the method 132 proceeds to an eighth step 148. In the eighth step 148, if a device (or asset) number has been entered, then the method 132 proceeds to a ninth step 150. If a device number has not been entered, then the method 132 proceeds to the fifth step 142 and an error message is displayed.

In the ninth step 150, the device number is validated. In a tenth step 152, if the device number is valid, then control proceeds to the fifth step 144. Otherwise, the method 132, proceeds to the fifth step 142.

With specific reference to FIG. 8, in one embodiment the returned player information is displayed on the remote device 50A in a player information screen 152. In the illustrated embodiment, the player information may include, but is not limited to, a player name, a player address, a patron host name, at least one anniversary date, e.g., birthday, wedding anniversary, sign-up date, any meters tracked by the player tracking system, such as bonus points (incentive points or credits), jackpots, coin-out, coin-in, and win/(loss).

C. Remote Device Information

Figure 9A:
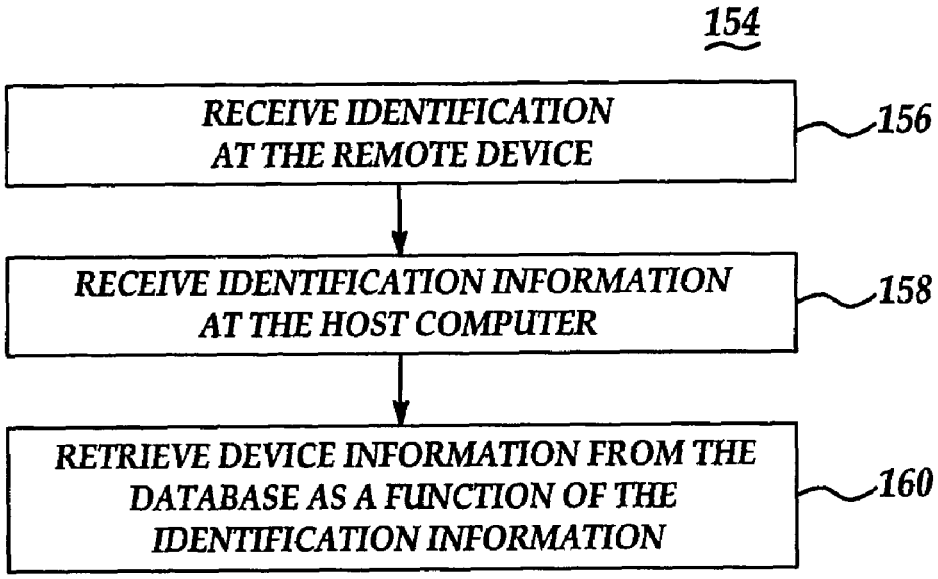
FIG. 9A is a first flow diagram of a method for remotely accessing information related to a device, according to an embodiment of the present invention.
Figure 10:
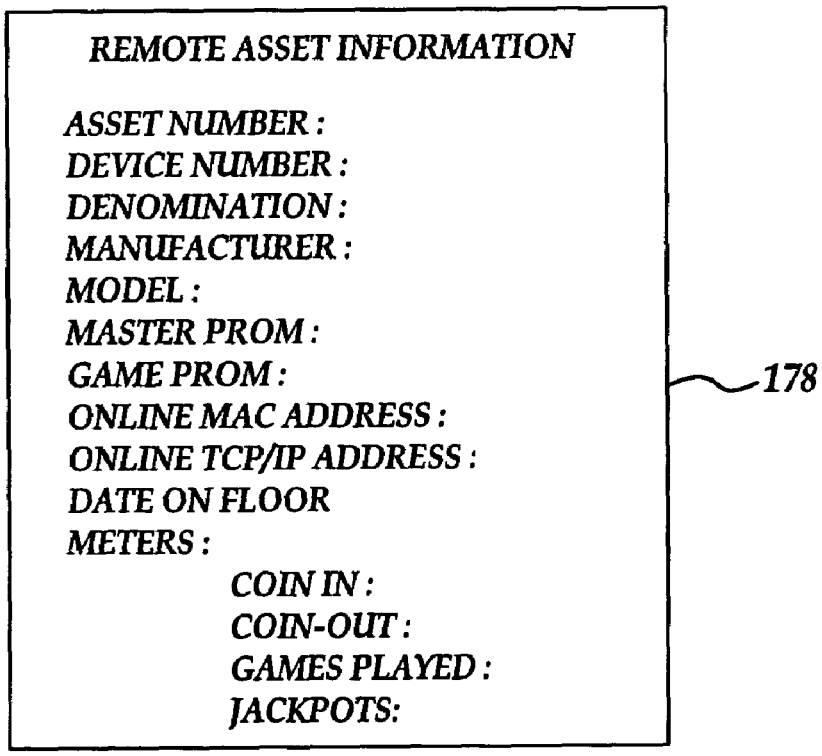
FIG. 10 is a diagrammatic illustration of a remote asset information screen, according to an embodiment of the present invention.
Figure 9B:
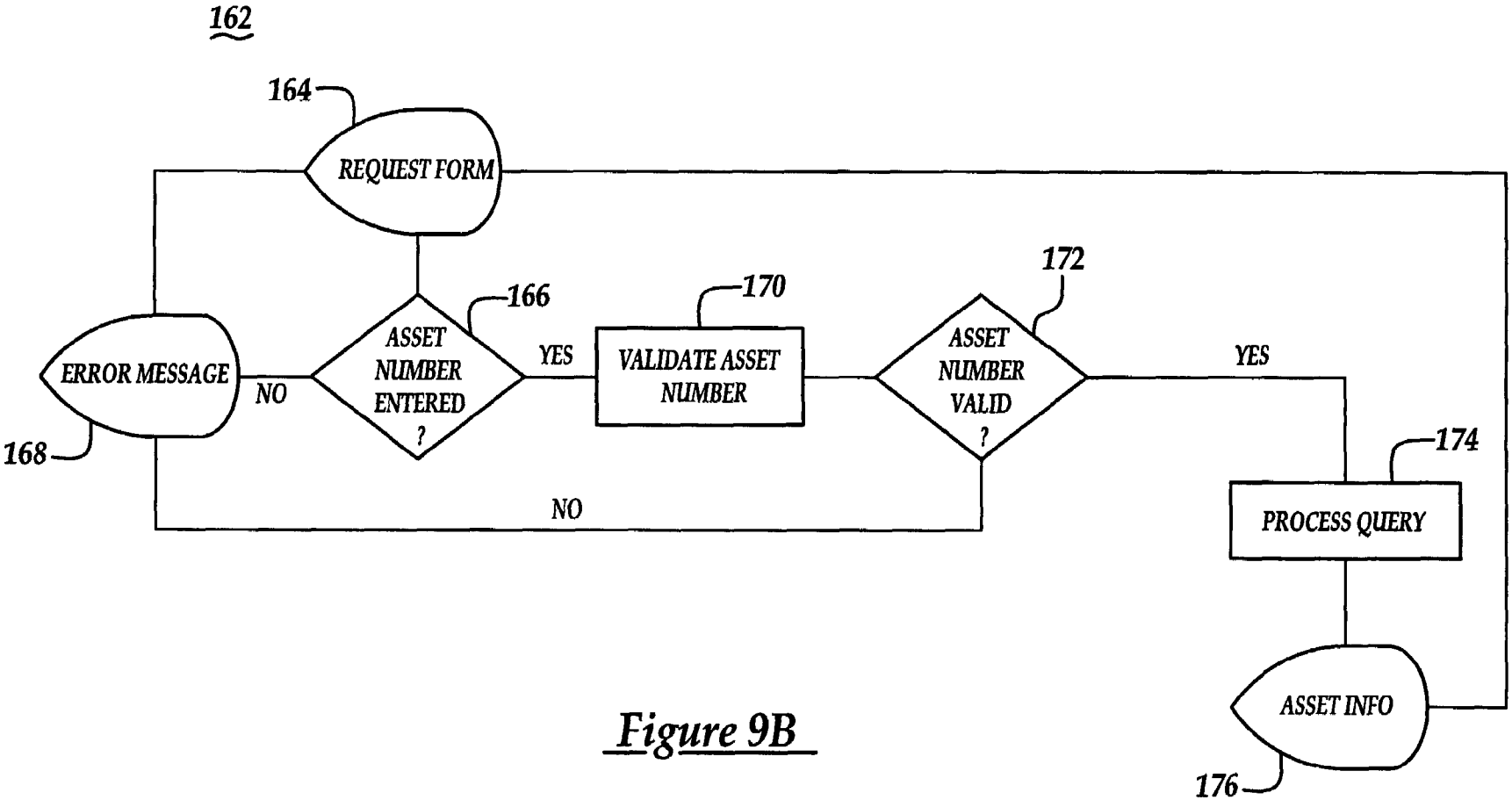
FIG. 9B is a second flow diagram of a method for remotely accessing information related to a device, according to a second embodiment of the present invention.

With reference to FIGS. 9A, 9B and 10, the remote system 48 allows the user 54, such as a slot floor employee or a slot technician, to quickly remotely request and receive asset or device information related to an gaming device 12.

In the illustrated embodiment, interaction with the user 54, including receiving input and displaying the asset information is accomplished using the web client 56.

In one aspect of the present invention, the user 54 may identify the gaming device 12, such as an electronic gaming machine 13 by entering identification information. In one embodiment, the identification information is an asset or device ID number. The ID number may be manually entered by the user 54. In another embodiment, the user 54 may use the barcode reader 66 to read a barcode, located on the gaming device 12, containing the device ID number.

In one embodiment, the user navigates to a servlet for requested device information using the menu layer 80. The menu layer 80 requests the servlet from the host computer 18 from which it is then downloaded to the remote device 50A.

The servlet displays a request form (not shown) which is displayed to the user 54. After the asset or device ID number entered, the ID number is sent to the remote network interface 68, which process the query, and returns the requested device information to the remote device 50A where it is displayed.

With specific reference to FIG. 9A, a first method 154 for remotely requesting information related to a specific gaming device 12 is provided. In a first step 156, identification information is received at the remote device 50A. In a second step 158, the identification information is received at the host computer 18. In a third step 160, the device information is retrieved from the database 22 as a function of the identification information.

With specification reference to FIG. 9B, a second method 162 is for remotely requesting device information using the remote device 50A is shown, according to an embodiment of the present invention.

In a first step 164, the request form is displayed on the remote device 50A. In a second step 166, if an asset number has been entered then the method 162 proceeds to a third step 170. Otherwise, an error message is displayed in a fourth step 168.

In the third step 170, the asset number is validated. In a fifth step 172, if the asset number is valid then the method 162 proceeds to a sixth step 174. In the sixth step 174, the query (request for asset information) is processed by the host computer 18. The device or asset information is returned to the remote device 50A to be displayed in a seventh step 176.

With specific reference to FIG. 10, in one embodiment the returned asset information is displayed on the remote device 50A in a remote asset information screen 178. In the illustrated embodiment, the asset information may include, but is not limited to, an asset number, a device number, a denomination (the base denomination the device accepts), a manufacturer, a model, a master prom identifier, a game prom identifier, an online MAC address, an online TCP/IP address, a date on floor, and any or all available system meters, such as, coin in, coin out, games player, and jackpots.

D. Remote Cash Ticket Processing

In one embodiment, a gaming system includes a gaming machine that may issue a cash ticket. The cash ticket is issued when a player elects to quit playing a particular gaming machine after accumulating a number of credits. The number of credits is generally the sum of an original number of credits, any downloaded credits, any inserted credits, and any winnings (or losses).

With reference to FIGS. 11A, 11B and 12, the remote system 48 allows the user 54, such as a slot floor employee or patron host to quickly and remotely process a cash ticket issued by a particular gaming machine 13. The cash ticket issued by the gaming machine 13 includes cash ticket information such as a cash ticket id and a value printed on the cash ticket. The user 54 may be approached by a player 24 who requests to cash out a cash ticket and receive the value of the cash ticket.

If the player 24 wants to cash out, the user 54, via the remote device 50A, requests a cash ticket form. The remote network interface 68 sends the cash ticket form to the remote device 50A.

When the user 54 selects the cash ticket form from the menu layer 80, the web client 56 relays the request to the remote network interface 68. The remote network interface 68 retrieves the cash ticket form and sends the cash ticket form to the remote device 50A for display and interaction with the user 54 via the web client 56.

The cash ticket form may include a cash ticket button for selecting by the user 54 to communicate each step of the cash ticket processing that has occurred. For example, the cash ticket button is a request button that the user 54 selects when the user 54 is approached by the player 24. The cash ticket button may be an acknowledge button selected by the user 54 after validating the cash ticket and prior to processing the cash ticket. The cash ticket button may also be a process button selected by the user 54 after confirming that the cash ticket may be paid. The cash ticket button may also be a paid button to confirm that the user 54 has paid to the player 24 the value of the cash ticket. Each time the cash ticket button is selected by the user 54, the remote device 50A sends a notification of the event and the remote network interface 68 stores the notification in the host computer 18 which then updates the data in the database 23 relating to the status of the cash ticket processing.

The cash ticket form may also include a field wherein the user 54 enters the cash ticket id such as a number. The user 54 enters cash ticket information or data onto the remote device 50A to verify that the cash ticket is valid and has not been previously processed. If the cash ticket id is invalid or the cash ticket has already been processed, an error message is displayed at the remote device 50A. The cash ticket information is sent by the remote device 50A to the host computer 18 where cash ticket information is retrieved and sent back to the remote device 50A. In one embodiment, the cash ticket id is entered manually, then the user 54 selects a cash ticket entry button to send the cash ticket form to the host computer 18. In another embodiment, the cash ticket id is encoded in a barcode printed on the cash ticket. The bar code is read by the bar code reader and sent to the host computer 18.

In one embodiment, the user 54 navigates to a servlet 24 using the menu layer 80 for inputting and retrieving cash ticket information. The menu layer 80 requests the servlet from the host computer 18 from which it is then downloaded to the remote device 50A.

After the validity of cash ticket is confirmed, the cash ticket information is retrieved from the database 22 by the remote network interface 68 and displayed to the user 54 at the remote device 50A. With specific reference to FIG. 12, in one embodiment the returned cash ticket information is displayed on the remote device 50A in a cash ticket information screen 196.

The cash ticket information includes ticket details 168, such as a gaming machine identifier. The gaming machine identifier includes a gaming machine id and a gaming machine location to identify the gaming machine issuing the cash ticket. The ticket details 168 further include a date identifier for identifying the issue date of the cash ticket, a shift identifier for identifying the work shift during which the cash ticket was issued, and a value identifier for identifying the value of the cash ticket, thereby allowing the user 54 to confirm the value printed on the cash ticket and the value stored in the host computer 18.

With specific reference to FIG. 11A, a first method 170 for processing a cash ticket using the remote device 50A, according to a first embodiment of the present invention is shown. In a first step 172, a fillable cash ticket form is sent to the remote device 50A. In a second step 174, the cash ticket information is entered on the cash ticket form via the remote device 50A.

With specific reference to FIG. 11B, a second method 176 for processing the cash ticket using the remote device 50A, according to a second embodiment of the present invention is shown.

In a first step 178, the cash ticket form is displayed on the remote device 50A. In a second step 180 a cash ticket id is entered. In a third step 182, the cash ticked id is verified. If the cash ticket id is invalid, then the method 176 proceeds to a fourth step 184. If the cash ticket id corresponds to a valid unprocessed cash ticket, then the method 178 proceeds to a fifth step 186. In the fourth step 184, an error message is displayed and the method 176 returns to the first step 178.

In the fifth step 186, the ticket details are retrieved from the database 22 and control proceeds to a seventh step 188. In the seventh step 188, the ticket details are processed and display at the remote device 50A. The user 54 may then pay the player. As discussed above, the user may be required to acknowledge through the selection of the cash ticket button at each step. Once the user has acknowledged that the player has been paid, the remote display displays a cash ticket paid message in an eighth step 190.

E. Remote Jackpot Ticket Processing

In one embodiment, a gaming system includes a gaming machine that may issue a jackpot ticket. In one embodiment, a jackpot ticket is issued by the gaming machine when a play of the game results in a win having an associated number of credits over a predetermined number of credits. Such a jackpot causes the gaming machine 12 to lock up, issue an alert and prevents the player from playing.

In another embodiment, the gaming machine 12 does not issue jackpot ticket. However, the user 54 may be required to go to the gaming machine 12 to process the jackpot With reference to FIGS. 13A, 13B and 14A, the remote system 48 allows the user 54, such as a slot floor employee, to quickly and remotely process a jackpot issued by a particular gaming machine 13. The jackpot issued by the gaming machine 13 has associated jackpot information such as a jackpot id and a value of the jackpot.

In one embodiment, the jackpot is dispensed by the gaming machine 13, while jackpots above the threshold require interaction with an employee, i.e., the user 54. Additionally, the jackpot may be required to be paid by a cashier. If a jackpot ticket has been issued, the user 54 may be approached by a player 24 who requests to collect the value of the jackpot. Alternatively, the user 54 may have to travel to the gaming machine 13 to process the jackpot.

If the player 24 wants to collect the jackpot, the user 54, via the remote device 50A, requests a jackpot form (not shown). The remote network interface 68 sends the jackpot form to the remote device 50A.

When the user 54 selects the jackpot form from the menu layer 80, the web client 56 relays the request to the remote network interface 68. The remote network interface 68 retrieves the jackpot form and sends the jackpot form to the remote device 50A for display and interaction with the user 54 via the web client 56.

The jackpot form includes a jackpot button for selecting by the user 54 to communicate each step of the jackpot processing that has occurred. For example, the jackpot button is a request button that the user 54 selects when a jackpot is announced and the user 54 is approached by the player 24 to collect the jackpot. The jackpot button may be an acknowledge button selected by the user 54 after validating the jackpot and prior to processing the jackpot. The jackpot button may also be a process button selected by the user 54 after confirming that the jackpot may be paid. The jackpot button may also be a paid button to confirm that the user 54 has paid to the player 24 the value of the jackpot. Each time the jackpot button is selected by the user 54, the remote device 50A sends a notification of the event and the remote network interface 68 stores the notification in the host computer 18 which then updates the data in the database 22 relating to the jackpot status in the jackpot processing.

In one embodiment, the jackpot form lists several fields having jackpot information, including the jackpot identifier, fill detail and jackpot status, for all active jackpots. The user 54 may select either the jackpot identifier or the jackpot status. If the user 54 selects the jackpot identifier, then jackpot detail is displayed on the remote device 50A. If the user 54 selects jackpot status, then the jackpot status advances to an advanced jackpot status, a notification is sent to the host computer 18 to update the database 22 and the remote device 50A displays the updated jackpot status on the jackpot form.

In another embodiment, the jackpot form includes a field wherein the user 54 enters the jackpot id such as a number. The user 54 enters jackpot information or data onto the remote device 50A to verify that the jackpot is valid and has not been previously processed. If the jackpot id is invalid or the jackpot has already been processed, an error message is displayed at the remote device 50A. The jackpot information is sent by the remote device 50A to the host computer 18 where jackpot information is retrieved and sent back to the remote device 50A.

In one embodiment, the jackpot id is entered manually, then the user 54 selects a jackpot entry button to send the jackpot form to the host computer 18. In another embodiment, the jackpot id is read by the bar code reader and sent to the host computer 18.

In one embodiment, the user 54 navigates to a servlet 24 using the menu layer 80 for inputting and retrieving jackpot information. The menu layer 80 requests the servlet from the host computer 18 from which it is then downloaded to the remote device 50A.

Figure 14A:
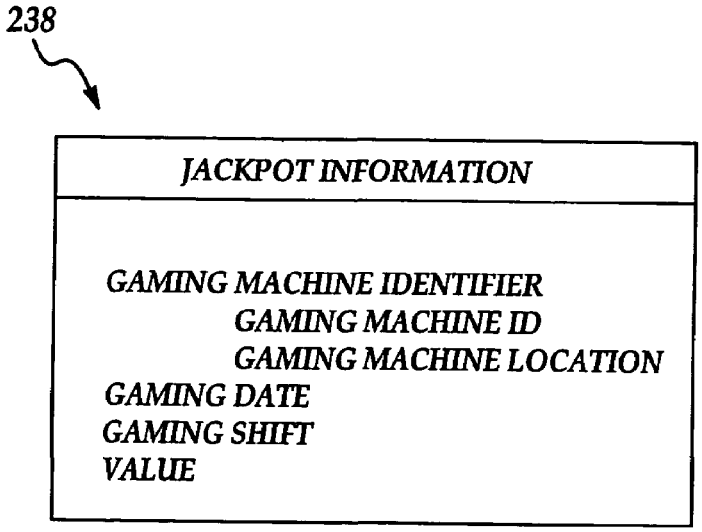
FIG. 14A is a diagrammatic illustration of a jackpot information screen, according to an embodiment of the present invention.
Figure 14B:
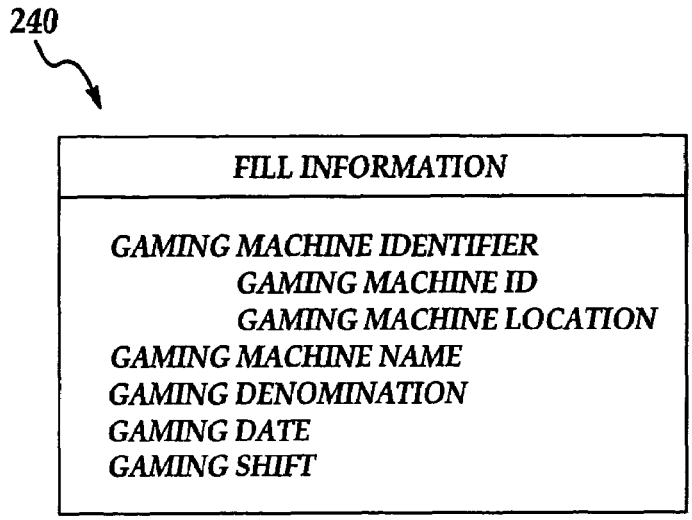
FIG. 14B is a diagrammatic illustration of a fill information screen, according to an embodiment of the present invention.

After the validity of jackpot is confirmed, the jackpot information is retrieved from the database 22 by the remote network interface 68 and displayed to the user 54 at the remote device 50A. With specific reference to FIG. 14A, in one embodiment the returned jackpot information is displayed on the remote device 50A in a jackpot information screen 238. With reference to FIG. 14B, in another embodiment, the returned fill information is displayed on the remote device 50A in a fill information screen 240.

The jackpot information includes fill detail 198, such as a gaming machine identifier. The gaming machine identifier includes a gaming machine id and a gaming machine location to identify the gaming machine issuing the jackpot. The fill detail 198 further includes a gaming date for identifying the issue date of the jackpot, a gaming shift for identifying the work shift during which the jackpot was issued, and a jackpot value for identifying the value of the jackpot, thereby allowing the user 54 to confirm the value printed on the jackpot and the value stored in the host computer 18.

If the user 54 selects the jackpot identifier field on the jackpot form, jackpot detail 200 as a function of the jackpot identifier is retrieved from the host computer 18 and displayed at the remote device 50A. Jackpot detail 200 may include the gaming machine id and the gaming machine location to identify the gaming machine issuing the jackpot. The jackpot detail 200 may further include a gaming machine name for identifying the particular game issuing the jackpot, a gaming denomination for identifying the particular type of credit issued, the gaming date for identifying the issue date of the jackpot, and the gaming shift for identifying the work shift during which the jackpot was issued.

Figure 13A:
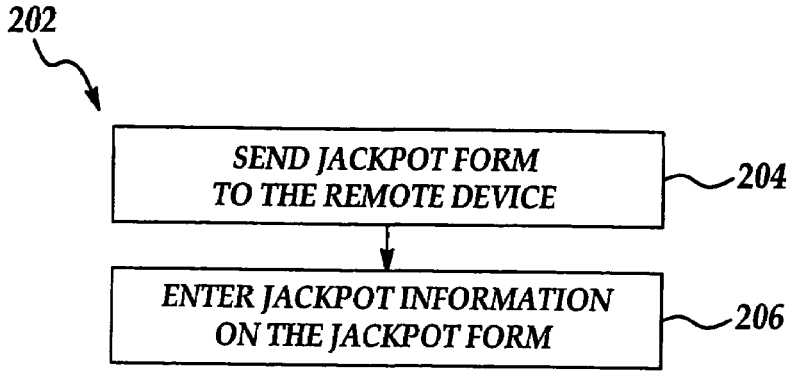
FIG. 13A is a first flow diagram of a method for remotely processing jackpot tickets, according to an embodiment of the present invention.

With specific reference to FIG. 13A, a first method 202 for processing a jackpot using the remote device 50A, according to a first embodiment of the present invention is shown. In a first step 204, a selectable jackpot form is sent to the remote device 50A. In a second step 206, the jackpot information is entered on the jackpot form via the remote device 50A.

Figure 13B:
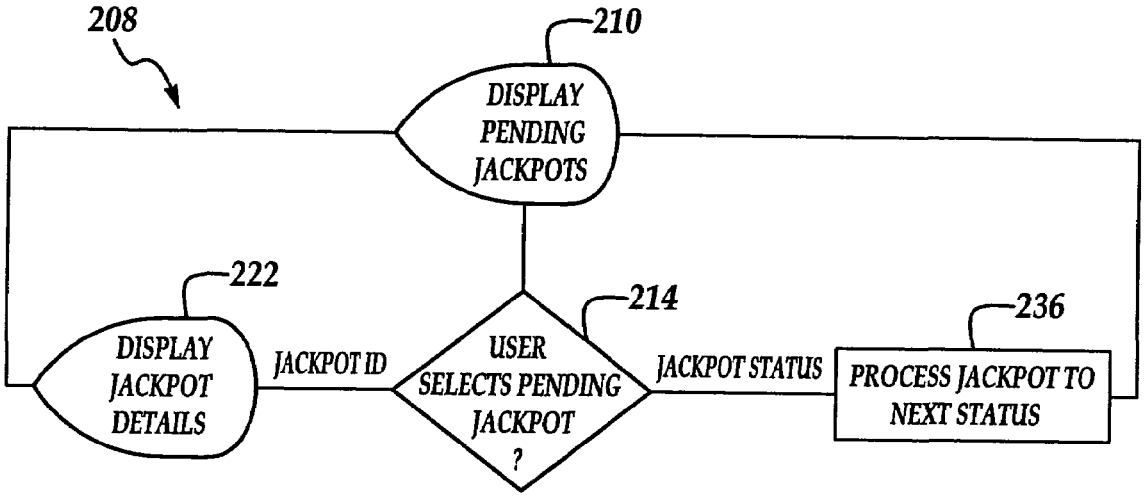
FIG. 13B is a second flow diagram of a method for remotely processing jackpot tickets, according to a second embodiment of the present invention.

With specific reference to FIG. 13B, in another aspect of the present invention, a method 208 for displaying or processing jackpots is shown. In a first step 210, all pending jackpots are displayed. In one embodiment, the list of pending jackpots includes at least a jackpot id and a jackpot status. In a second step 214, if the user 54 selects jackpot id of a jackpot, the method 208 proceeds to a third step 222. If the user 54 selects the jackpot status, the method 208 proceeds to a fourth step 236. In the third step 222, jackpot details are displayed on the remote device 50A. In the fourth step 236, the selected jackpot is processed by the user 54.

F. Remote Hopper Fill Ticket Processing

With reference to FIGS. 15A, 15B, 16A and 16B, the remote system 48 allows the user 54, such as a slot floor employee to quickly and remotely process a hopper fills in a particular gaming machine 13, i.e., insert credits or coins into the game machine's hopper to be dispensed to the player 24 when a jackpot has been won, when the game machine has run out or is low on credits. The number of credits remaining in the hopper (not shown) are tracked by the host computer 18 (or game machine 13 and relayed to the host computer)which issues an alert when the number of credits remaining reaches a certain amount so that the hopper may be restocked with credits such as coins, tokens, paper money, or the like.

Once an alert is issued, the user 54, via the remote device 50A, may acknowledge the alert and request a hopper fill form (not shown). The remote network interface 68 sends the hopper fill form to the remote device 50A.

When the user 54 selects the hopper fill form from the menu layer 80, the web client 56 relays the request to the remote network interface 68. The remote network interface 68 retrieves the hopper fill form and sends the hopper fill form to the remote device 50A for display and interaction with the user 54 via the web client 56.

In one embodiment, the hopper fill form includes a hopper fill button (not shown) for selecting by the user 54 to communicate each step of the hopper fill processing that has occurred. For example, the hopper fill button is a request button that the user 54 selects when an alert is announced and the user 54 approaches the gaming machine 13 to process the hopper fill. The hopper fill button may also be an acknowledge button selected by the user 54 after validating the hopper fill and prior to processing the hopper fill. The hopper fill button may also be a process button selected by the user 54 after confirming that the hopper is being restocked. The hopper fill button may also be a fill button to confirm that the user 54 has completed restocking the hopper. Each time the hopper fill button is selected by the user, the remote device 50A sends a notification of the event and the remote interface stores the notification in the host computer 18 which then updates the data in the database 22 relating to the credit status in the hopper fill processing.

In one embodiment, the hopper fill form lists several fields having hopper fill information, including the hopper fill identifier, fill detail and credit status, for all active hopper fills. The user 54 may select either the hopper fill identifier or the credit status. If the user 54 selects the hopper fill identifier, then hopper fill detail is displayed on the remote device 50A. If the user 54 selects credit status, then the credit status advances to an advanced credit status, a notification is sent to the host computer to update the database and the remote device displays the updated credit status on the hopper fill form.

In another embodiment, the hopper fill includes a field wherein the user 54 enters the hopper id, such as a number. The user 54 enters hopper fill information or data onto the remote device 50A to verify that the hopper id is valid and has not been previously processed. If the hopper id is invalid or the hopper fill has already been processed, an error message is displayed at the remote device 50A. The entered hopper fill information is sent by the remote device 50A to the host computer 18 where additional hopper fill information is retrieved and sent back to the remote device 50A. In one embodiment, the hopper id is entered manually, then the user 54 selects a hopper fill entry button to send the hopper fill form to the host computer 18. In another embodiment, the hopper id is read from a barcode on the hopper or on the game machine 13 by the bar code reader 66 and sent to the host computer 18.

In one embodiment, the user 54 navigates to a servlet 24 using the menu layer 80 for inputting and retrieving hopper fill information. The menu layer 80 requests the servlet from the host computer 18 from which it is then downloaded to the remote device 50A.

Figure 16A:
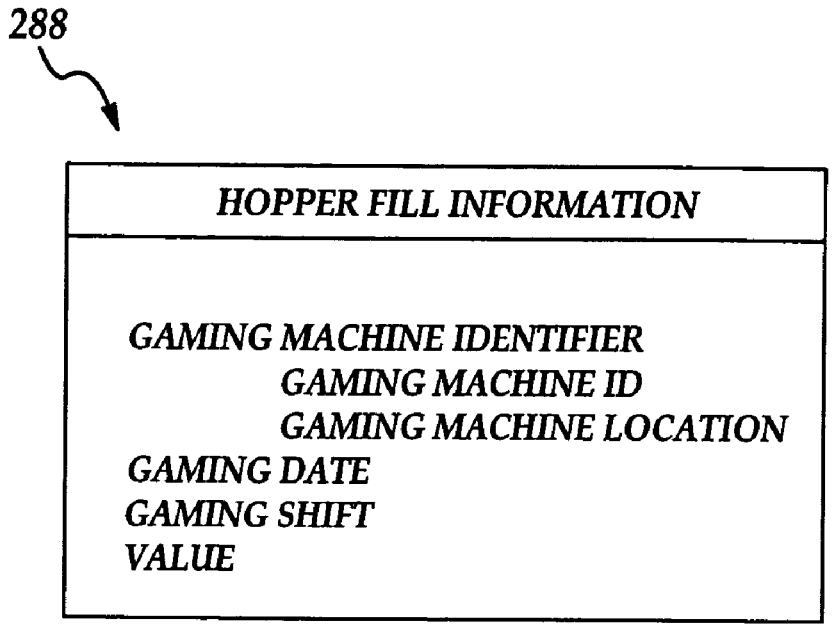
FIG. 16A is a diagrammatic illustration of a hopper fill information screen, according to an embodiment of the present invention.
Figure 16B:
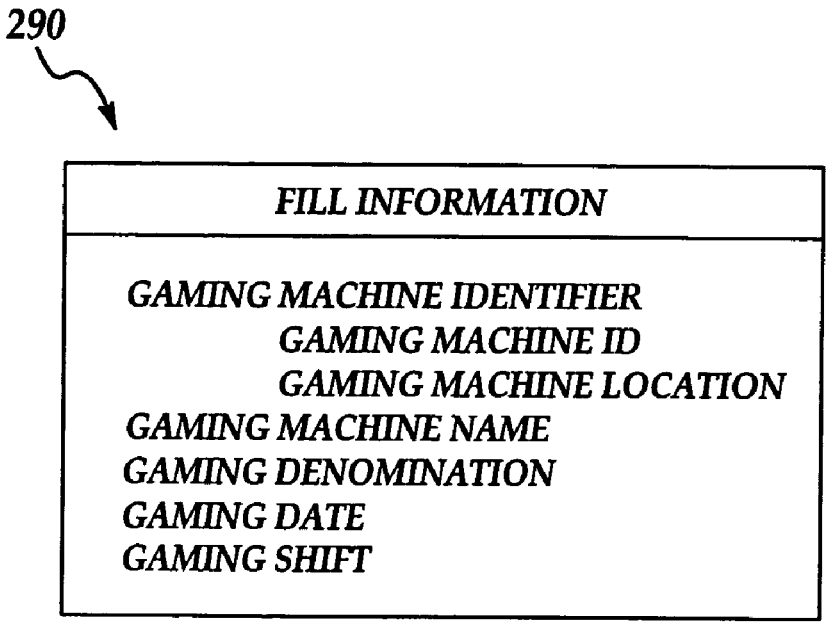
FIG. 16B is a diagrammatic illustration of a fill information screen according to an embodiment of the present invention.

After the validity of hopper is confirmed, the hopper fill information is retrieved from the database 22 by the remote network interface 68 and displayed to the user 54 at the remote device 50A. With specific reference to FIG. 16A, in one embodiment the returned hopper fill information is displayed on the remote device 50A in a hopper fill information screen 288. With reference to FIG. 16B, in another embodiment, the returned fill information is displayed on the remote device 50A in a fill information screen 290.

The hopper fill information includes fill detail 248, such as a gaming machine identifier. The gaming machine identifier includes a gaming machine id and a gaming machine location to identify the gaming machine requiring the hopper fill. The fill detail 248 may further include a gaming date for identifying the issue date of the fill, a gaming shift for identifying the work shift during which the fill was issued, and/or a credit value for identifying the value of the credits supplied.

If the user 54 selects the hopper fill identifier field on the hopper fill form, hopper fill detail as a function of the hopper fill identifier is retrieved from the host computer 18 and displayed at the remote device 50A. In one embodiment, the hopper fill detail includes the gaming machine id and the gaming machine location to identify the gaming machine requiring the credit or hopper fill. The hopper fill detail may further include a gaming machine game for identifying the particular game issuing the credits, a gaming denomination for identifying the particular type of credit issued, the gaming date for identifying the fill date of the hopper, and/or the gaming shift for identifying the work shift during which the hopper was filled.

Figure 15A:
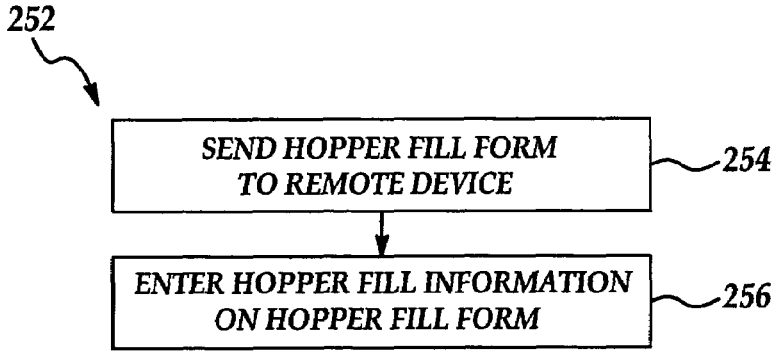
FIG. 15A is a first flow diagram of a method for remotely processing hopper fills, according to an embodiment of the present invention.

With specific reference to FIG. 15A, a first method 252 for processing a hopper fill using the remote device 50A, according to a first embodiment of the present invention is shown. In a first step 254, a selectable hopper fill form is sent to the remote device 50A. In a second step 256, the hopper fill information is entered on the hopper fill form via the remote device 50A.

Figure 15B:
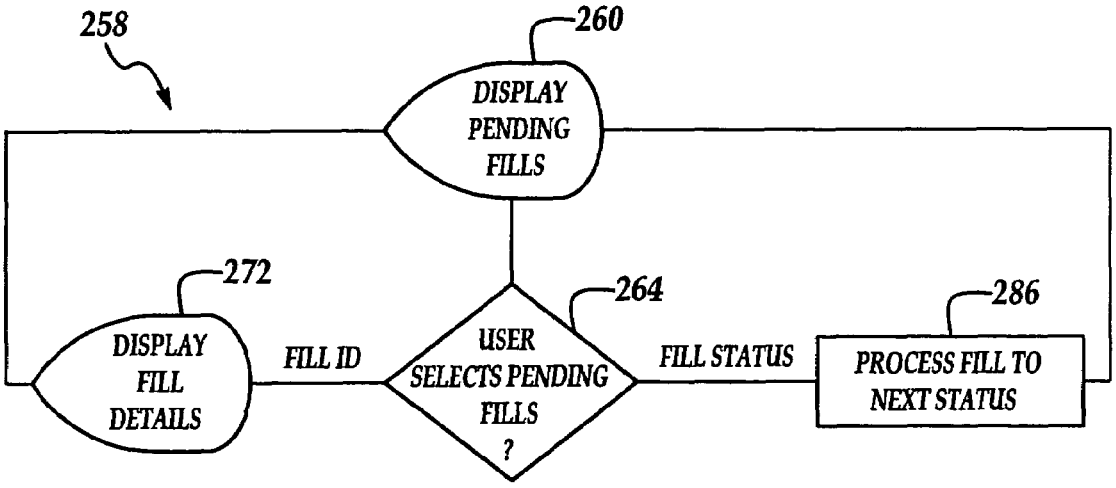
FIG. 15B is a second flow diagram of a method for remotely processing hopper fills, according to a second embodiment of the present invention.

With specific reference to FIG. 15B, a second method 258 for processing the hopper fill using the remote device 50A, according to a second embodiment of the present invention is shown.

In a first step 260, the remote device 50A displays selectable hopper fill information, including pending fills having a credit status and hopper fill identifier. In an alternate embodiment, the hopper fill form or gaming machines 13 having hopper fill information, is displayed on the remote device 50A. In one embodiment, the hopper fill information is selectable. In another embodiment the hopper fill information is fillable requiring credit refill.

In a second step 262, the user 54 selects a pending fill. If the user 54 selects the hopper fill identifier, control proceeds to a third step 264, the fill detail is displayed and control returns to the first step 260. If the user 54 selects the credit status, then the credit status advances to an advanced credit status and control returns to the first step 260. If all required information was not entered, then an error message is displayed and the hopper fill form is displayed again.

Then he hopper id is verified. If the hopper id is not valid, then the method 258 displays an error message (fourth step 266). If the hopper id is valid, then the fill detail is retrieved from the database 22 and displayed at the remote device 50A.

After the hopper is filled with credits by the user 54, the remote display displays a credit filled message.

If the user selects another hopper fill identifier, the hopper fill detail is retrieved from the host computer and displayed on the remote device 50A.

If the user selects a credit status, the credit status advances to an advanced credit status which is then displayed at the remote device 50A.

G. Remote Table Rating Interface

Figure 17A:
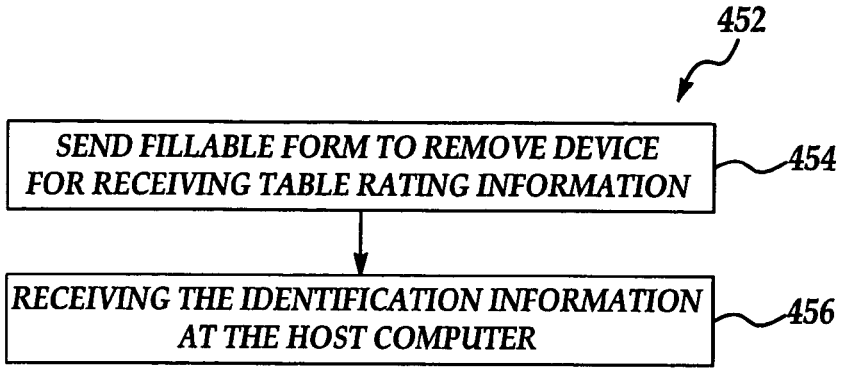
FIG. 17A is a first flow diagram of a method for remotely providing a table rating interface, according to an embodiment of the present invention.
Figure 17B:
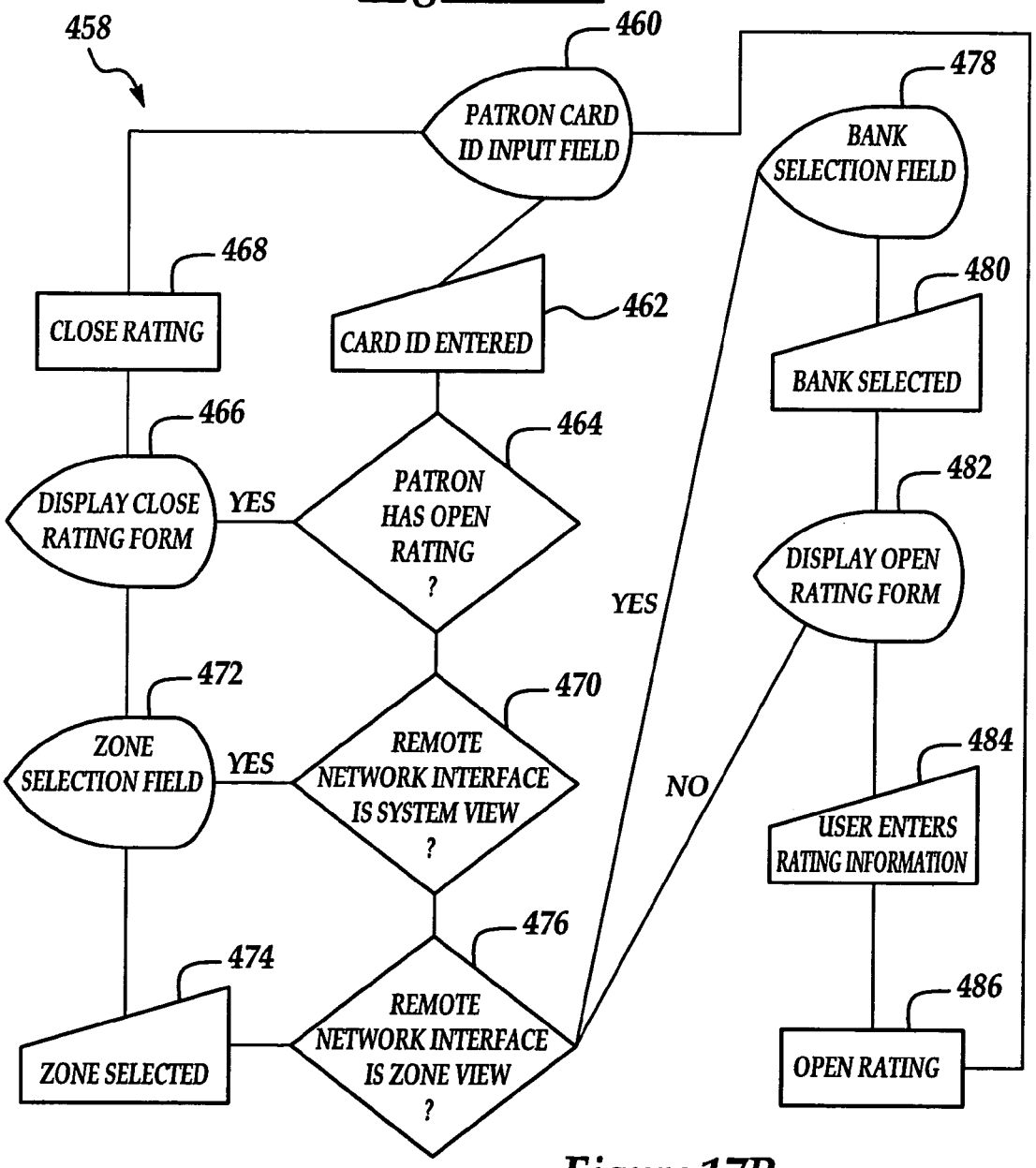
FIG. 17B is a second flow diagram of a method for remotely providing a table rating interface, according to a second embodiment of the present invention.
Figure 18:
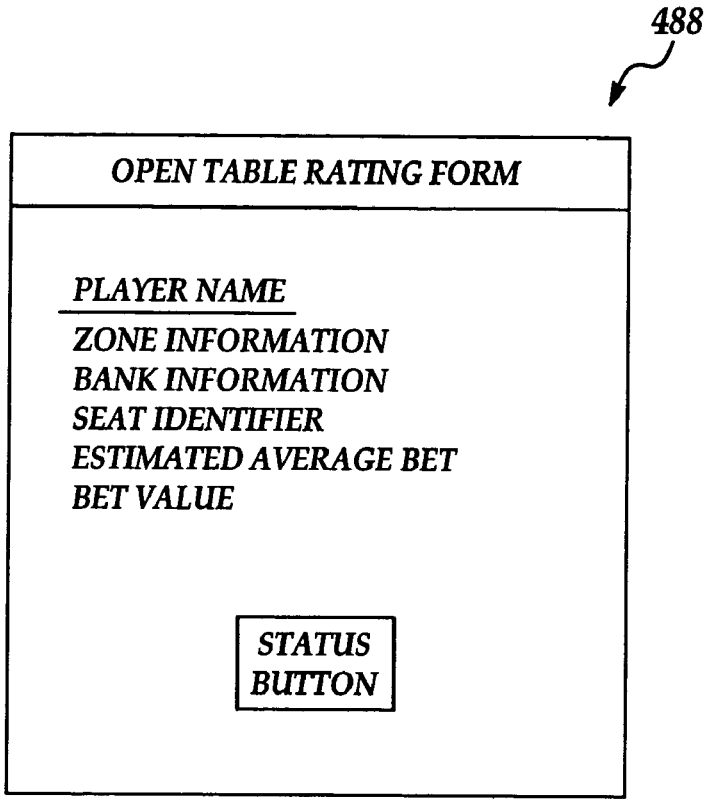
FIG. 18A is a diagrammatic illustration of an open table rating screen, according to an embodiment of the present invention.

With reference to FIGS. 17A, 17B, and 18, the remote system 48 allows the user 54, such as a slot floor employee or patron host, to quickly and remotely process a table rating and, send and receive table rating information 450 related to a specific player 24. A table rating allows the gaming system 10 to rate or rank the player 24 by determining his or her given session or play, determine his or her worth to the casino, and assign a point award.

In the illustrated embodiment, interaction with the user 54, including receiving input and displaying the player information, is accomplished using the web client 56.

In one aspect of the present invention, the user 54 may identify the player 24 through entry of the player's ID card number into the remote device 50A. In one embodiment, the ID card number may be entered manually. In another embodiment, the ID card number may be read from the player's ID card using the card reader 62 or the barcode reader 66 as appropriate.

In another aspect of the present invention, if the player 24 is utilizing one of the devices 12 and has identified themselves to the gaming system by entry of the ID card into the device 12 and/or entered in their PIN number, the user 54 may identify the player 24 by entering a device ID number associated with the respective device 12. As discussed below, the gaming system has associated the ID number of the device 12 with the player 24 while the player 24 is using the device 12. Thus, using the device ID number, the host computer 18 may determine the ID number of the player 24.

In one embodiment, the user 54 navigates to a servlet for requesting player information using the menu layer 80. The menu layer 80 requests the servlet from the host computer 18 from which it is then downloaded to the remote device 50A.

The servlet displays a table rating form which is displayed to the user 54. As discussed above, the user 54 may either enter the player ID card number of the player 24 (manually or reading it from the ID card) or a device ID number associated with a device 12 being used by the player 24. The user 54 enters the player information (in the form of the player ID card number or the device ID number) which is returned to the host computer 18 by the web client 56. The remote network interface 68 receives the player information, retrieves the table rating information 450 and returns the table rating information 450 to the remote device 50A where it is displayed. With specific reference to FIG. 18, in one embodiment the returned table rating information is displayed on the remote device 50A in an open table rating form screen 486.

When the player information is entered, the remote network interface 68 determines whether the information is valid. If valid, the table rating information 450 is stored in or retrieved from the database 22 as a function of the identification information. If invalid, an error message is displayed on the remote device 50A. The player information 450 includes a player identifier such as a player number, player name and address, and the like.

The purpose of the table rating information 450 is to register and display a patron's risk or ranking at a particular gaming machine. The risk or ranking informs the user 54 about the player's 24 spending or risk habits during a given session of play at a gaming machine.

The player information includes a table rating status of open or closed for a particular gaming machine 13. If the status is open, the player is currently playing the particular gaming machine 13, thereby enabling the user to generate a table rating. When the player 24 decides to discontinue playing, the user 54 swipes the player's 24 ID card and brings up the table rating status in a closed status form (not shown) having fillable fields and a status button. The user 54 enters table rating information about the session, including but not limited to the player name, the gaming machine 13, the gaming machine location, the time the player 24 began play, the time the player 24 ceased play, the average bet by the player 24, and the amount won by the player 24 when leaving the gaming machine 13. The user 54 selects the status button and the table rating is established, sent to the database via the remote network interface and stored therein. Thereafter, any remote devices displaying a table rating form relating to the particular gaming machine 13 displays the newly entered table rating information.

If, after swiping the player's card, the player 24 does not have an open table rating, an open table form is displayed on the remote device. The open table form is fillable by the user 54 with table rating details which may include the player's name, the zone information (gaming machine location), a selectable list of the bank information (gaming machines 13) available at that location, a seat identifier at which the player 24 is seated, the estimated average bet by the player 24, the bet value the player is opening the gaming machine 13 with. The zone information entered by the user 54 may also include bank information as a function of the zone information. The bank information associated with the zone information is displayed and the user 54 selects the appropriate banking information associated with the particular gaming machine 13.

Once the information is entered, the user 54 selects the status button to send and store the table rating details to the database 22 and update the table rating status to open. The updated table rating status is sent to all remote devices displaying information for the particular gaming table. The update may be sent automatically or upon request.

With specific reference to FIG. 17A, a first method 452 for remotely requesting table rating information relating to a player 24 is provided. In a first step 454, a fillable form is sent to a remote device for receiving table rating information. In a second step 456, the table rating information is received at the host computer for processing a table rating for the player.

With specific reference to FIG. 17B, a second method 458 for remotely processing a table rating using the remote device 50A is shown, according to a second embodiment of the present invention.

In a first step 460, the table rating form is displayed on the remote device 50A.

In a second step, if a player ID card number is entered, then the method proceeds to a third step. The table rating status is then returned to the remote device 50A to be displayed in the third step 464.

In a fourth step 466, if the table rating status is open, the closed status form is displayed on the remote device.

In a fifth step 468, t the table rating is closed and control returns to the first step 460. In the third step 464, if the table rating status is not open, then the method 458 proceeds to a sixth step 470.

In the sixth step 470, the system determines if the remote network interface is a casino. System view shows the zones of the system and control proceeds to a seventh step 472. If the system view shows the zones then control proceeds to a seventh step 472, otherwise control proceeds to a ninth step 476.

In the seventh step 472, zone information is displayed.

In an eighth step 474, zone is selected and control proceeds to the ninth step 476.

In the ninth step 476, the system determines if the remote network interface shows the zone view and control proceeds to a tenth step 478.

If the system shows the zone view, then bank information is shown in the tenth step 478 and control proceeds to an eleventh step 480. Otherwise, control proceeds to a twelfth step 482.

In the eleventh step 480, a bank is entered, and control proceeds to the twelfth step 482.

In the twelfth step 482, the open rating form is displayed and control proceeds to a thirteenth step 484.

In the thirteenth step 484, the user 54 enters table rating information.

In the fourteenth step 486, the table rating is opened and control returns to the first step 460.

H. Remote Attendance

Figure 19A:
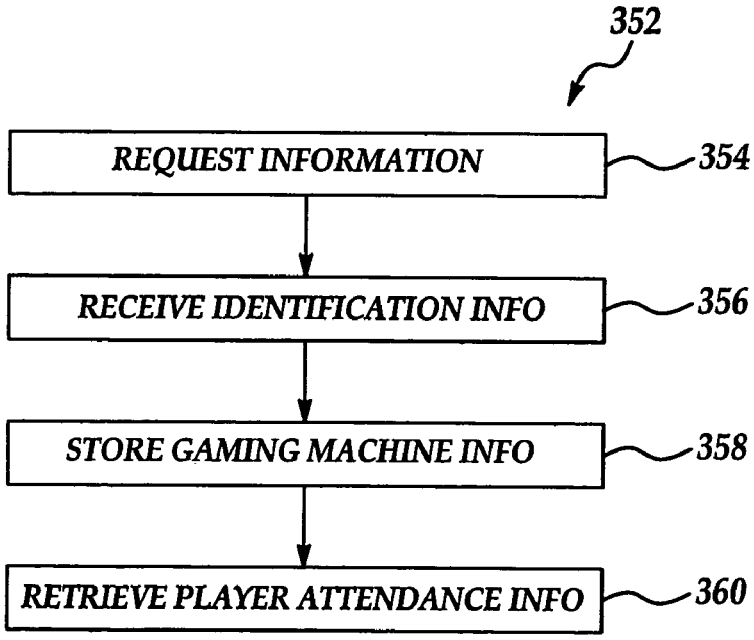
FIG. 19A is a first flow diagram of a method for remotely providing an attendance interface, according to an embodiment of the present invention.
Figures 19B, 20:
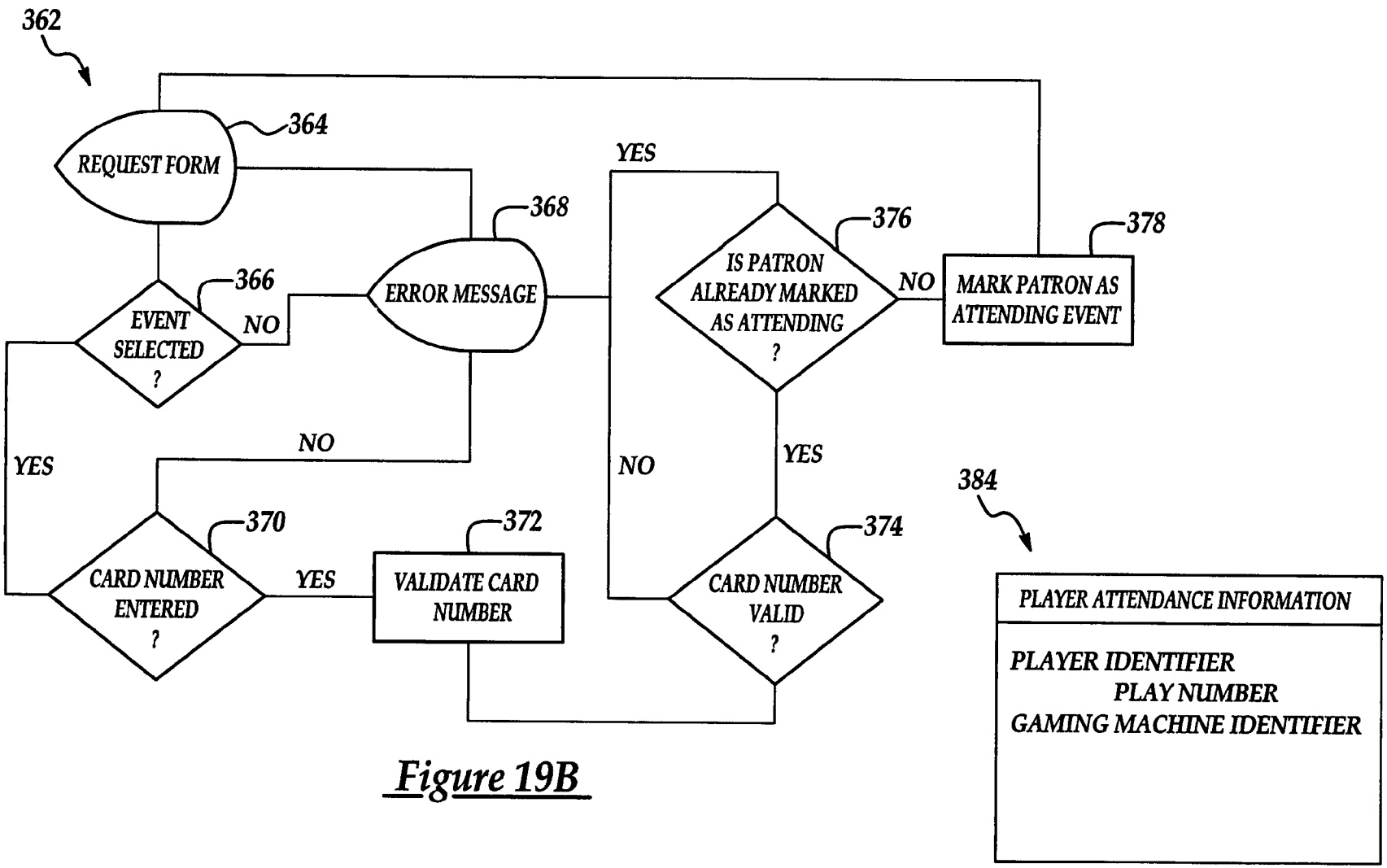
FIG. 19B is a second flow diagram of a method for remotely providing an attendance interface, according to a second embodiment of the present invention.
FIG. 20 is a diagrammatic illustration of a player attendance information screen, according to an embodiment of the present invention.

With reference to FIGS. 19A, 19B, and 20, the remote system 48 allows the user 54, such as a slot floor employee or patron host, to quickly and remotely request, send and receive player attendance information 350 related to a specific player 24. For example, a marketing or special event may be targeted to patrons or players meeting defined criteria. Each player who attends the event is identified as their attendance is stored in the player tracking system.

In the illustrated embodiment, interaction with the user 54, including receiving input and displaying the player attendance information, is accomplished using the web client 56.

In one aspect of the present invention, the user 54 may identify the player 24 through entry of the player's ID card number into the remote device 50A. In one embodiment, the ID card number may be entered manually. In another embodiment, the ID card number may be read from the player's ID card using the card reader 62 or the barcode reader 66 as appropriate.

In another aspect of the present invention, if the player 24 is utilizing one of the devices 12 and has identified themselves to the gaming system by entry of the ID card into the device 12 and/or entered in their PIN number, the user 54 may identify the player 24 by entering a device ID number associated with the respective device 12. As discussed below, the gaming system has associated the ID number of the device 12 with the player 24 while the player 24 is using the device 12. Thus, using the device ID number, the host computer 18 may determine the ID number of the player 24.

In one embodiment, the user 54 navigates to a servlet for requesting player attendance information using the menu layer 80. The menu layer 80 requests the servlet from the host computer 18 from which it is then downloaded to the remote device 50A.

The servlet displays an attendance form which is displayed to the user 54. As discussed above, the user 54 may either enter the player ID card number of the player 24 (manually or reading it from the ID card) or a device ID number associated with a device 12 being used by the player 24. The user 54 enters identification information (in the form of the player ID card number or the device ID number) which is returned to the host computer 18 by the web client 56. The remote network interface 68 receives the identification information, retrieves the player attendance information 350 and returns the player attendance information 350 to the remote device 50A where it is displayed. With specific reference to FIG. 20, in one embodiment the returned player attendance information is displayed on the remote device 50A in an player attendance information screen 384.

When the identification information is entered, the remote network interface 68 determines whether the identification is valid. If valid, the gaming machine information is stored in or retrieved from the database 22 as a function of the identification information. If invalid, an error message is displayed on the remote device. 50A. The gaming machine information includes a device identification number, and the player attendance information is retrieved from the database 22 as a function of the device identification number. The player attendance information 350 includes a player identifier such as a player number, player name and address, and the like. The player attendance information 350 includes a gaming machine identifier which indicates what gaming machines the player 24 has attended on a particular day.

The purpose of the player attendance information 350 is to register and display a patrons attendance at a particular gaming machine or marketing event. Attempting to register a player 24 already registered will generate and display an error.

With specific reference to FIG. 19A, a first method 352 for remotely requesting information relating to a player 24 is provided. In a first step 354, identification information is received at the remote device. In a second step 356, the identification information is received at the host computer. In a third step 358, identification information is stored in the database, i.e., the player before is marked as the player attending the event. In a fourth step 360, the player attendance information is retrieved from the database 22 as a function of the identification information.

With specific reference to FIG. 19B, a second method 362 for remotely requesting player information using the remote device 50A is shown, according to a second embodiment of the present invention.

In a first step 364, the attendance form is requested by the user 54 on the remote device 50A.

In a second step 366, the user 54 selects and enters an event or gaming via machine and control proceeds to a fourth step 370.

In a third step 368, an error message is displayed if the user does not enter or select an event and control returns to the first step 364.

In the fourth step 370, if a player ID card number is entered, then the method 362 proceeds to a fifth step 372.

In the fifth step 372, the ID card number is validated.

In a sixth step 374, if system determines if the ID card number is not valid, and control proceeds to the third step 368 where an error message is displayed. If the ID card number is valid, then the method proceeds to a seventh step 376.

In the seventh step 376, if the player 24 is not marked as attending the event, the control proceeds to an eighth step 378.

In the eight step 378, the player's attendance at the gaming machine is registered by the system, and control returns to the first step 264.

I. Remote Surveillance

Figures 21A, 21B:
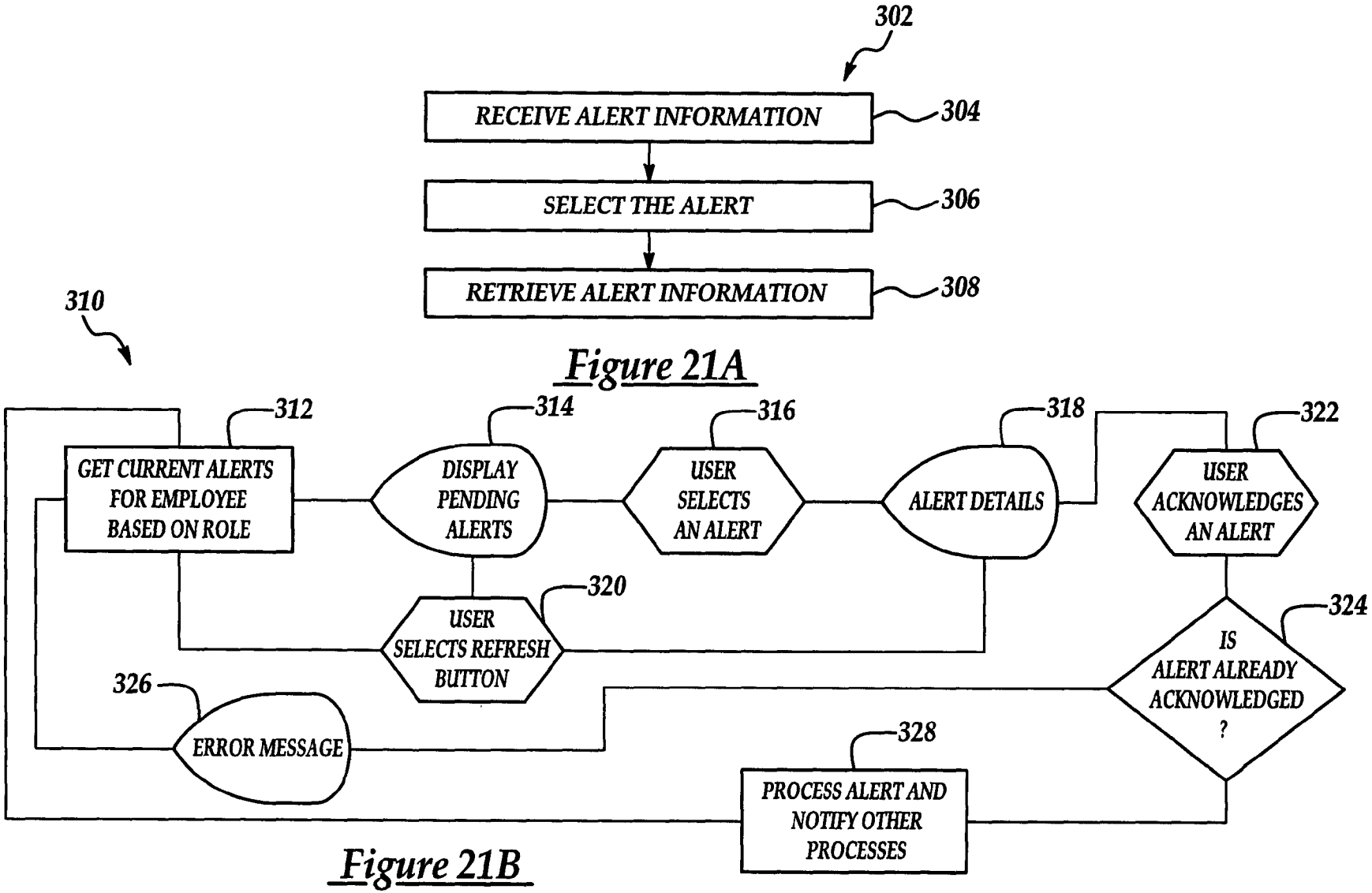
FIG. 21A is a first flow diagram of a method for remotely providing a surveillance interface, according to an embodiment of the present invention.
FIG. 21B is a second flow diagram of a method for remotely providing a surveillance interface, according to a second embodiment of the present invention.
Figure 22:
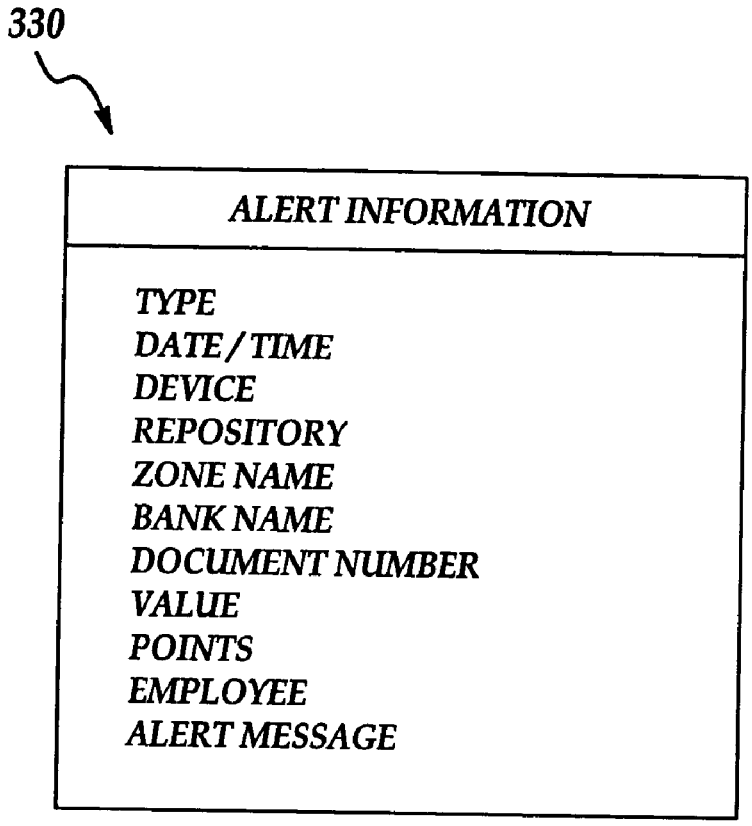
FIG. 22 is a diagrammatic illustration of an alert information screen, according to an embodiment of the present invention.

With reference to FIGS. 21A, 21B, and 22, the remote system 48 allows the user 54, such as a slot floor employee or patron host to quickly and remotely process an alert having data including user role information, alert information and alert detail issued by a gaming machine 13. The user role information is a system where each user 54 is assigned a role in a hierarchy of roles. The user's role and level on the hierarchy determines which functions and information the user can access and the operations the user can perform.

In the illustrated embodiment, interaction with the user 54, including receiving input and displaying the alert information, is accomplished using the web client 56.

In one aspect of the present invention, an alert form displays all active alerts and displays the alerts on the remote device 50A in an alert form as a function of the user role information. The alert form displays the alert and the date and time it occurred. The user 54 may identify the alert and select the alert via an alert button to acknowledge that the user 54 is addressing the alert and will clear the alert after it is addressed. After the user 54 addresses the alert and acknowledges that it is addressed, the database 22 is updated and the alert form is refreshed with updated alert information.

In the illustrated embodiment, the user 54 selects the alert from the alert form and alert details 300 are displayed. The alert details may include, but are not limited to, an alert type for describing the alert and an alert date for describing the date and time that the alert occurred. The alert details 300 may further include a device identifier for describing the gaming device the alert occurred on, a zone name for describing the zone of the gaming floor that the device is located in, and a bank name for describing the bank of the gaming floor that the device is located in. Additional alert details 300 may include a repository identifier for describing the repository the alert occurred on, a document identifier for describing a document created by the alert, an alert value for describing the value of the alert, and an alert point describing the point value of the alert. The alert details 300 may also further include an employee identifier for describing the employee that initiated the alert and an alert message providing a text description of the alert.

In one embodiment, the user 54 navigates to a servlet for requesting alert information using the menu layer 80. The menu layer 80 requests the servlet from the host computer 18 from which it is then downloaded to the remote device 50A.

In one embodiment, the servlet displays the alert form which is displayed to the user 54. As discussed above, the user 54 may select the alert displayed on the alert form to retrieve the alert detail 300 which is returned to the host computer 18 by the web client 56. The remote network interface 68 receives the alert information, retrieves the alert detail 300 and returns the alert detail 300 to the remote device 50A where it is displayed. With specific reference to FIG. 22, in one embodiment the returned alert information is displayed on the remote device 50A in an alert information screen 330.

With specific reference to FIG. 21A, a first method 302 for remotely processing an alert is provided. In a first step 304, alert information is received at the remote device. In a second step 306, the user selects the alert. In a third step 308, the alert information is retrieved from the database 22 as a function of the selected alert.

With specific reference to FIG. 21B, a second method 310 for remotely requesting player information using the remote device 50A is shown, according to a second embodiment of the present invention.

In a first step 312, the alert information is retrieved as a function of the user role.

In a second step 314, the retrieved alert information is displayed on the remote device 50A.

In a third step 316, the user selects an alert, then the method 310 proceeds to a fourth step 318.

In the fourth step 318, alert detail is retrieved and displayed as a function of the selected alert.

In a fifth step 320, the user selects an alert button for refreshing the alert information stored in the system 10.

In a sixth step 322, the user acknowledges the alert.

In a seventh step 324, the system determines if the alert has already been acknowledged.

In an eighth step 326, if the alert was previously acknowledged, an error message is displayed and the method returns to the first step 312. If the acknowledgement is valid, then the message proceeds to the ninth step 328.

In the ninth step 328, the alert is processed by the host computer 18, notification is sent to other processes in the system, including the database and control returns to the first step 312.

In the third step 316, the user selects the alert button to refresh the alert information displayed at the remote device 50A.

Obviously, many modifications and variations of the present invention are possible in light of the above teachings. The invention may be practiced otherwise than as specifically described within the scope of the appended claims.

J. Patron Point Adjustment

Figure 23A:
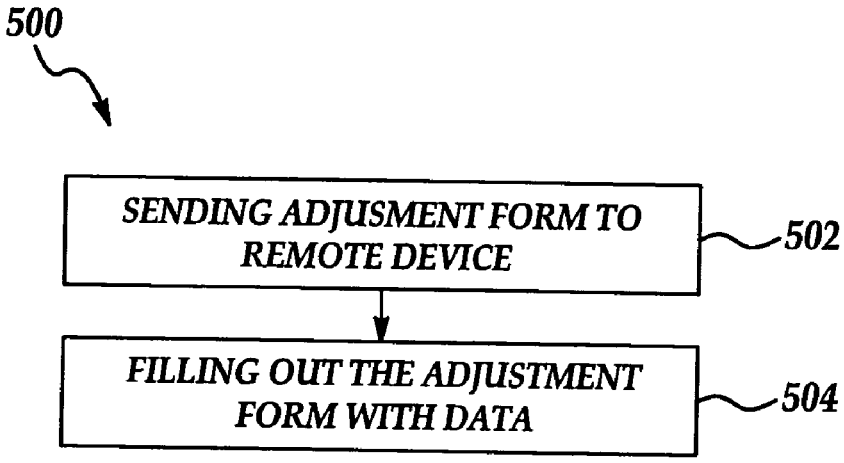
FIG. 23A is a flow diagram of a first method for adjusting points assigned to a player in a player tracking system, according to an embodiment of the present invention.
Figure 23B:
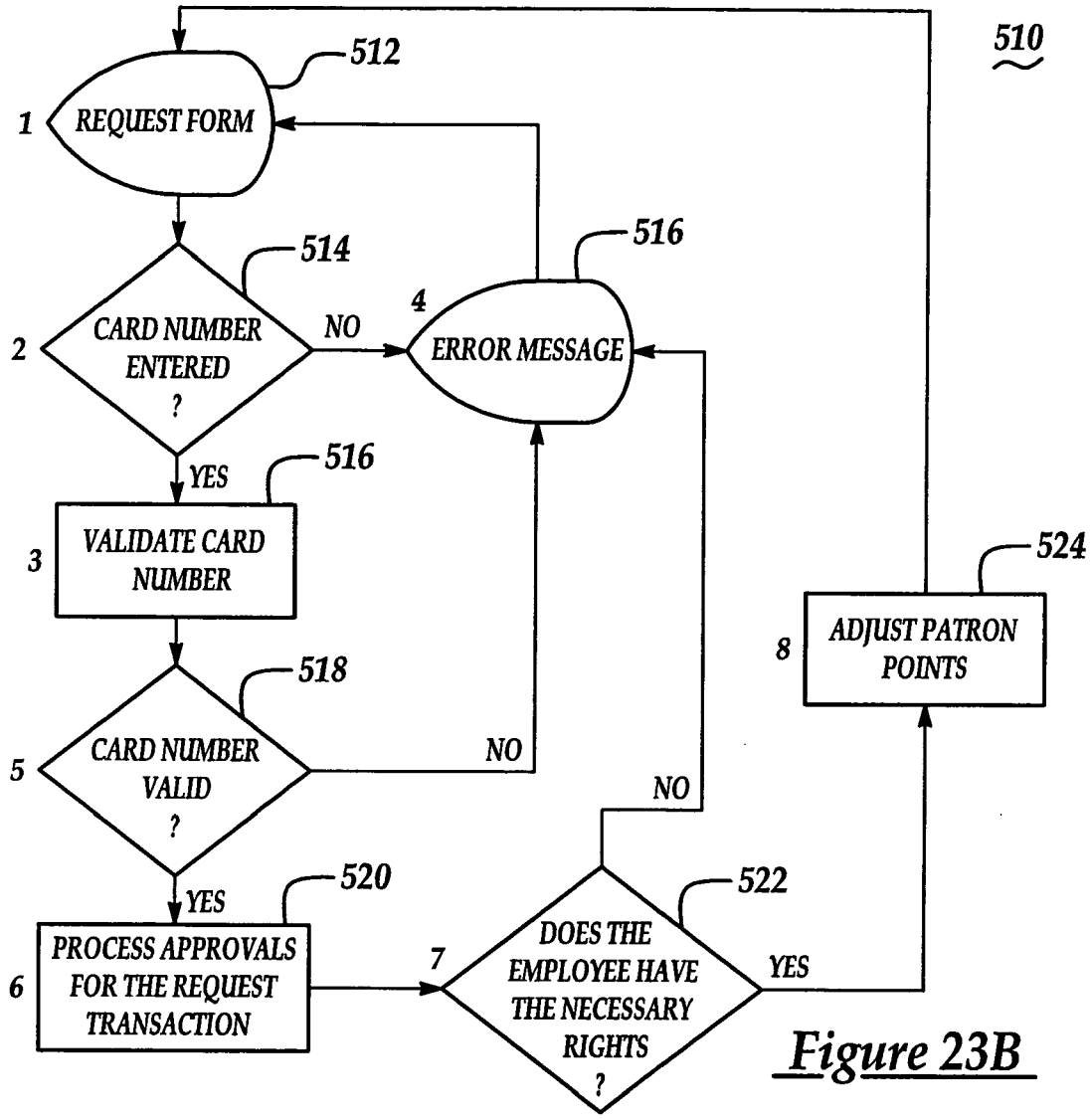
FIG. 23B is flow diagram of a second method for adjusting points assigned to a player in a player tracking system, according to another embodiment of the present invention.
Figure 24:
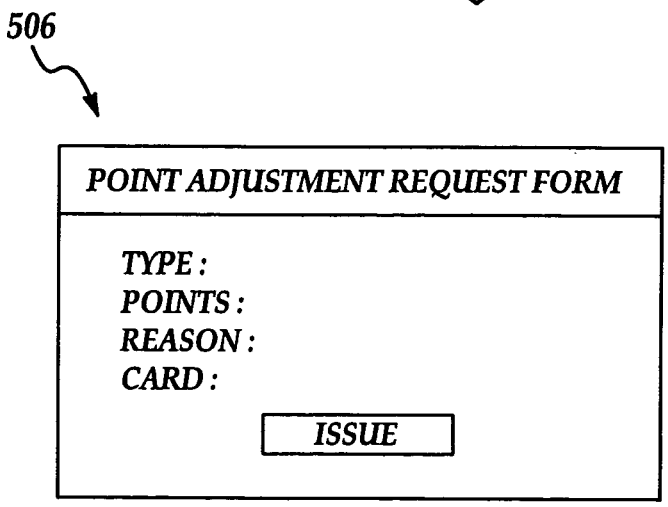
FIG. 24 is a diagrammatical illustration of a point adjustment request form, according to an embodiment of the present invention.

With reference to FIGS. 23A, 23B and 24, the remote devices 50 allow a user 54 to display and/or increase a player's point, e.g., bonus points, or comp point balance. In one embodiment, the remote network interface 68 exchanges data between the host computer 18 and the remoter device 50. The data includes adjustment information to adjust the points associated with a player 24 in the player tracking system.

In one embodiment, the data includes a point management form (not shown) which is sent from the remote network interface 68 to the remote device 50A. The point management form is fillable with player information by the user 54. The remote device 50 sends the player information to the remote network interface 68. Once the player 24 has been identified, the remote network interface 68 sends a point adjustment request from to the remote device 50A.

With specific reference to FIG. 24, a sample point adjustment request form 506, according to one embodiment, is shown. In the illustrated embodiment, the point adjustment request form allows the user 54 to enter the type of points, the number of points, the reason for the adjustment, and the player ID card number associated with the player 54. When finished, the user 54 may select an ISSUE button to send the date to the host computer is where the database 22 is updated.

With specific reference to FIG. 23B, a second method 510 for adjusting points associated with a player 24 in a player tracking system is shown. In a first step 512, a request is displayed on the remote device 50A. The user 54 may then fill out the form and send the form back to the host computer 18. In one embodiment, a player ID card number is manually entered on the remote device 59A. In another embodiment, the player ID card number is read from the ID card by the bar code reader 66 or the ID card reader 62.

In a second step 514, if a card number was entered, then the method 510 proceeds to a third step 516. If a card number was not entered, then the method 510 proceeds to a fourth step 516 and an error message is displayed. In the third step 516, the card number is validated. In a fifth step 518, if the card number is valid then the method 510 proceeds to a sixth step 520. In the sixth step 520, approval for the requested transaction is processed. In a seventh step 522 if the user or employee 54 has the necessary rights to adjust the player or patron's points then the method 512 proceeds to an eighth step 524. Otherwise, the method proceeds to the fourth step 516 and an error message is displayed. In the eighth step 524, the points are adjusted and the process returns the first step 512.

K. Comp Point Vouchers

Figure 25A:
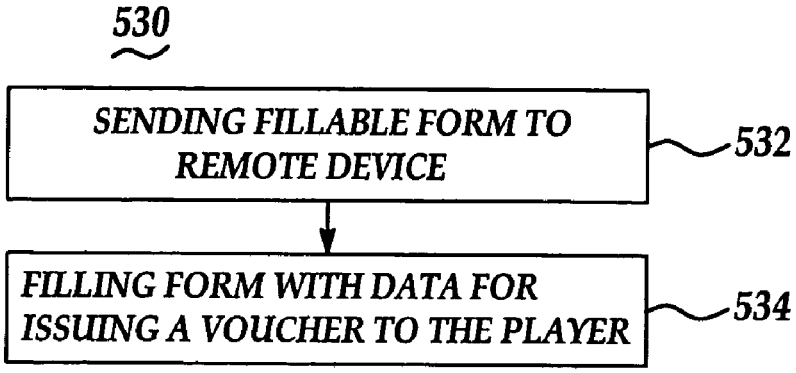
FIG. 25A is a flow diagram of a method for issuing vouchers to a player, according to an embodiment of the present invention.
Figure 26:
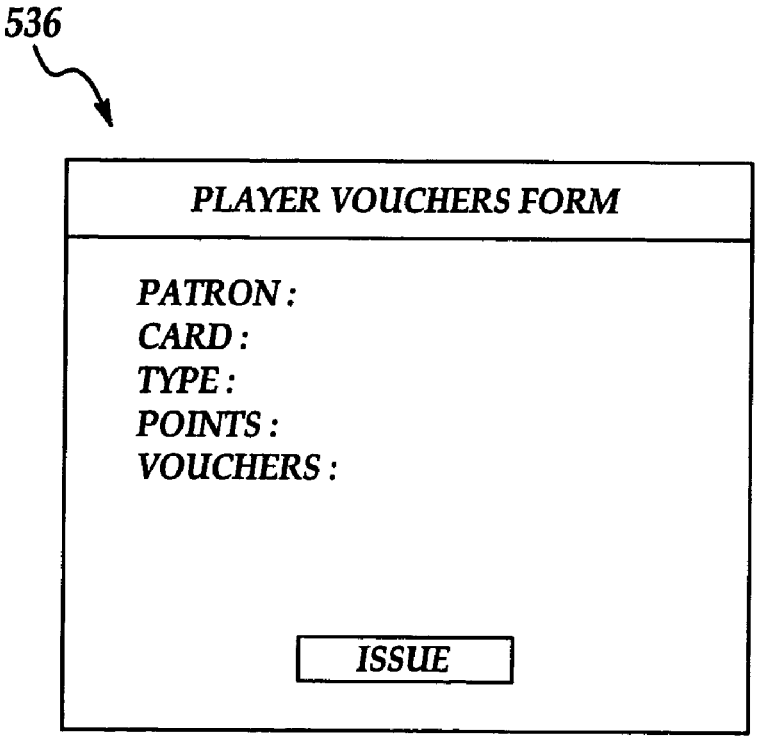
FIG. 26 is a diagrammatic illustration of a voucher information screen, according to an embodiment of the present invention.
Figure 25B:
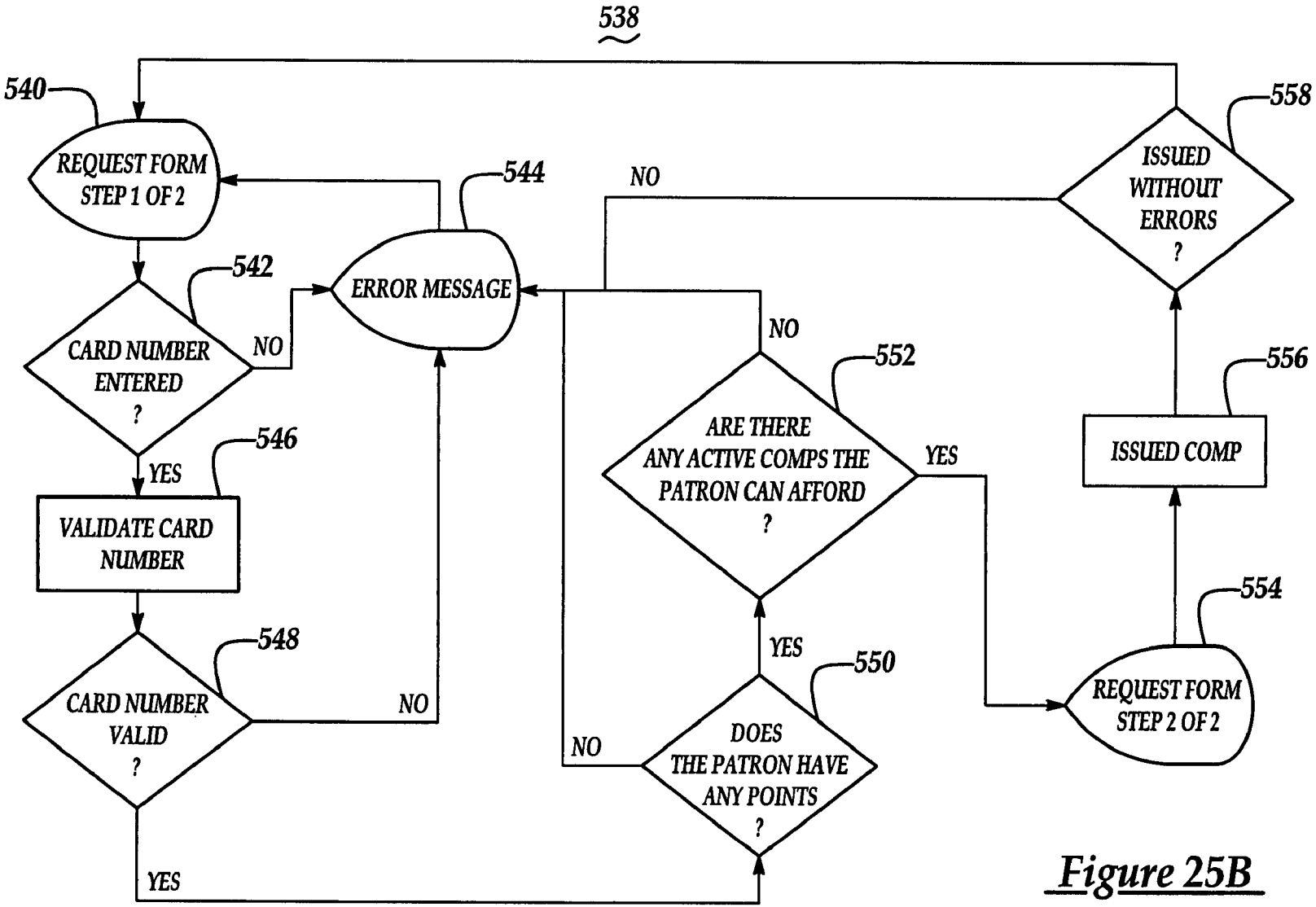
FIG. 25B is a flow diagram of a second method for issuing vouchers to a player, according to another embodiment of the present invention.

With reference to FIGS. 25A, 25B and 26, the remote device 50 may be used to issue point vouchers or comp point vouchers to a player 24. The vouchers may be embodied in a paper voucher which is printed on a remote printer carried by the user 54 or may be embodied in a pre-printed voucher having a voucher ID number which is carried by the user 54, and assigned to the player 24 in the player tracking system. Alternatively, the voucher may be embodied in a record stored in the database 22.

In one embodiment of the present invention, the remote network interface 68 exchanges data between the host computer 18 and the remote device 50A. The data includes voucher information to issue a voucher to the player 24 in the player tracking system. The voucher has at least one of an associated product and service. For example, the voucher may be redeemed for the associated product at a related retail store or redeemed for the associated service. Exemplary products includes free dinners and/or drinks.

As discussed below the remote network interface 68 may send a request form to the remote device 50A. The user 54 enters data onto the request form and the remote device sends the data to the remote network interface 68.

With specific reference to FIG. 25, in one embodiment of the present invention, a method 530 implements a player tracking system for use with the gaming system. In a first step 532 a fillable form is sent to the remote device 50A. In a second step 534, the form is filled with data for issuing a voucher to the player 24.

The user 54 may enter the player ID card number associated with the player 24 on the request form. In one embodiment, the player ID card number is entered manually. In another embodiment, the player ID card is read from the player ID card by the ID card reader 62 or the bar code reader 66. After the player has been identified, a list of the vouchers for which the patron has enough comp points to purchase are listed. With specific reference to FIG. 26, a player voucher form 536, according to an embodiment of the present invention, is shown. The player voucher form 536 displays the patron name, the player ID card number, the type of voucher being selected and the points associated with the patron in the player tracking system. The player voucher form 536 also lists the vouchers for which the patron may purchase based on the number of comp points they have.

With specific reference to FIG. 25B, a flow diagram of a second method 536 for assigning vouchers to a player in a player tracking system is shown. In a first step 540, a first request form is displayed on the remote device 50A. The first request form allows the user 54 to select the type of voucher, i.e., either point or comp point and to enter the card number of the player or patron 24. In a second step 542, if a card number was entered then the process proceeds to a third step 546. Otherwise, the method 538 proceeds to a fourth step 544 and an error message is displayed. In the third step 546, the player's ID card number is validated. In a fourth step 548, if the ID card number is valid, then the method 538 proceeds to a fifth step 550. Otherwise, the method 538 proceeds to the third step 544 and an error message is displayed. In the fifth step 550, if the player 24 has any points in the player tracking system, then the method 538 proceeds to a sixth step 552. Otherwise, the method 538 proceeds to the third step 544 and an error message is displayed. In the sixth step 552, if there are any active comps or vouchers that the player 24 can afford based on the number of points associated with the player 24 in the patron tracking system, then the method 538 proceeds to the seventh step 554. Otherwise, the method proceeds to the third step 544 and an error message is displayed. In the seventh step 554, a request form or player voucher form 548 is displayed on the remote device 50A. As discussed above, the player voucher form 548 displays a list of vouchers that the player can afford. If the user 54 selects one of the vouchers and selects the issue button, then the voucher or comps are issued in the eighth step 556. In a ninth step 558, if the comp or voucher was issued without errors then the method returns to the first step 540. Otherwise, the method returns to the third step 544 and an error message is displayed.

L. Redemption of Printed Vouchers

Figure 27A:
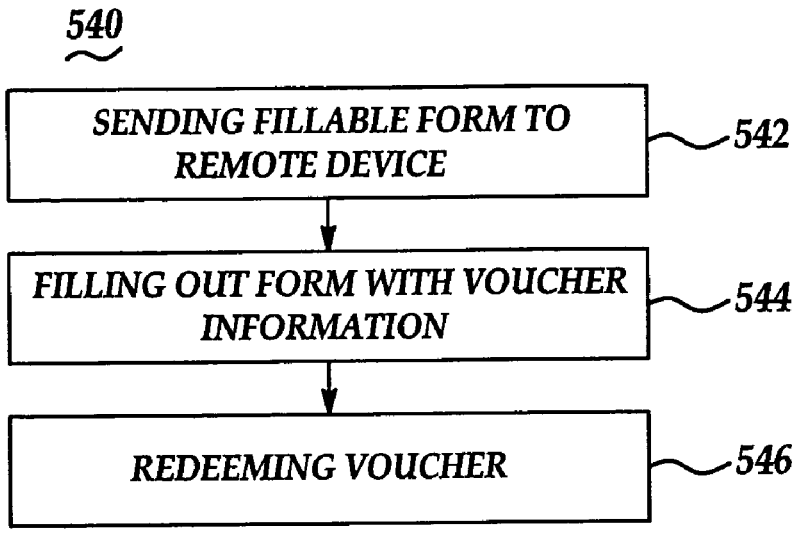
FIG. 27A is a flow diagram of a method for redeeming printed vouchers using a remote device, according to an embodiment of the present invention.
Figure 28:
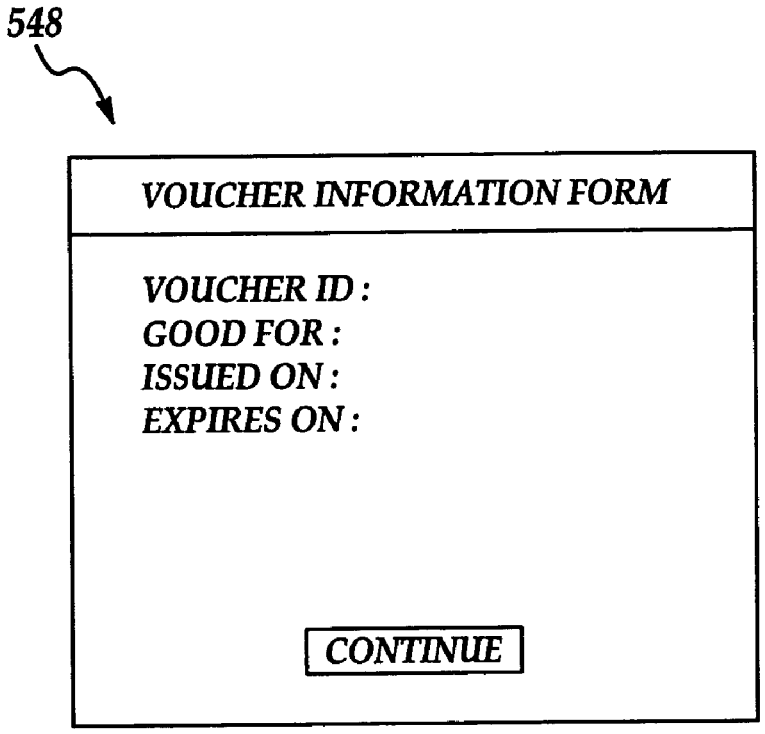
FIG. 28 is a diagrammatic illustration of a voucher information form, according to an embodiment of the present invention.
Figure 27B:
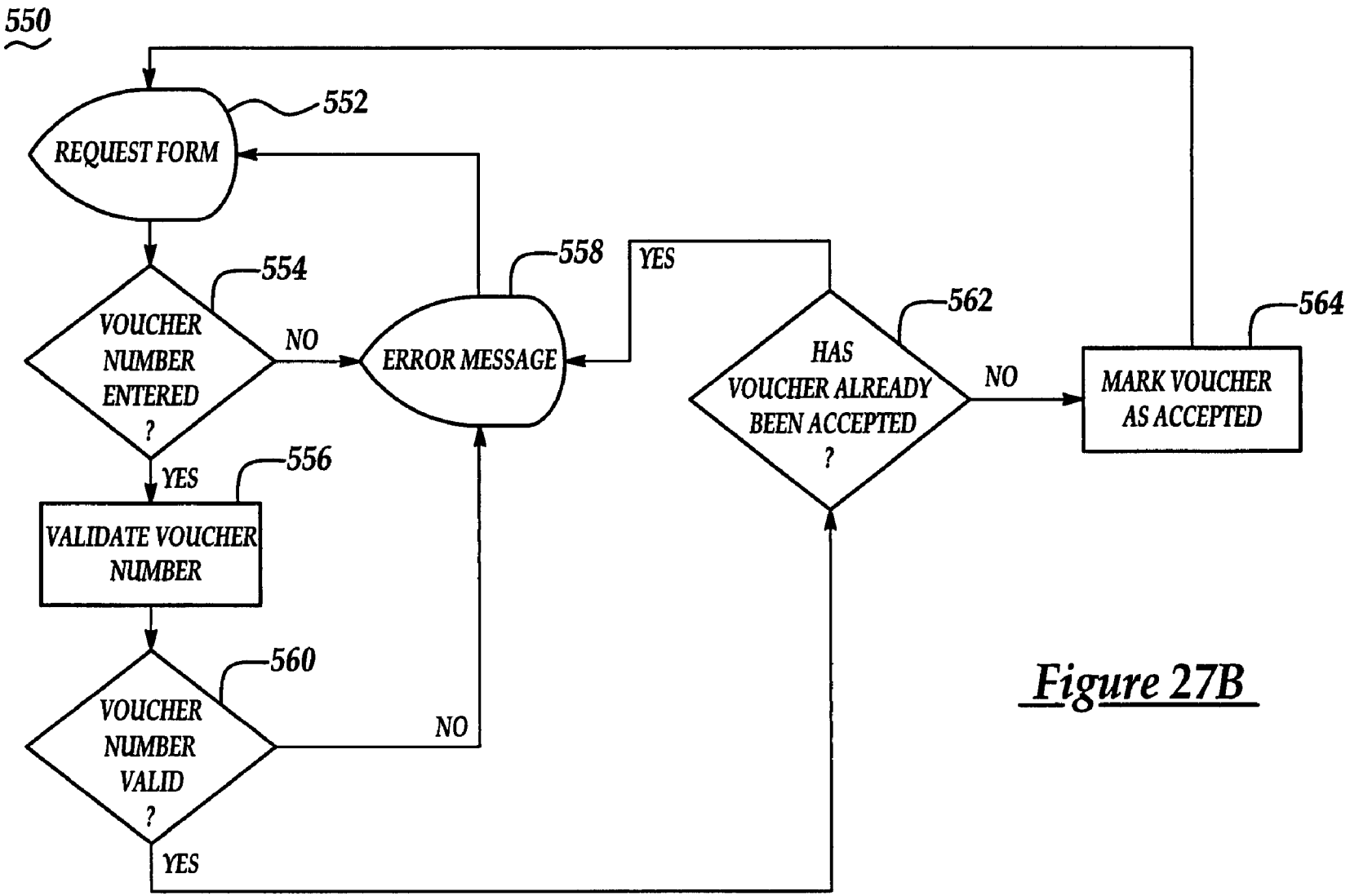
FIG. 27B is a flow diagram of a second method for redeeming printed vouchers using a remote device, according to an embodiment of the present invention.

With reference to FIGS. 27A, 27B and 28, the remote device 50 may be used to validated and process, i.e., redeem, printed vouchers. A printer voucher may be distributed for any number of reasons, for example, including a promotional event. Typically, the voucher may be redeemed for an associated service or product. For example, a printer voucher may be redeemed for a free dinner or drink.

As discussed below in one embodiment, the remote network interface 68 generates and delivers to the remote device 50A a request form. The user 54 may enter a voucher ID number onto the form. By pressing a continue button, the voucher ID may be validated and processed. A status may then be returned to the user 54.

With reference to FIG. 27A, in one embodiment a method 540 is used to redeem a voucher. In a first step 542, a fillable form is sent to the remote device 50A. In a second step 544, the fillable form is filled out without voucher information by the user 54A. In one embodiment, the voucher information includes a voucher ID number which may be entered manually or by reading a code on the voucher. For example, the code may be a bar code printed on the voucher which is read by the bar code reader 66. In a third step 546, the voucher ID number is validated and redeemed.

With specific reference to FIG. 28, in one embodiment, once a voucher has been identified by the remote network interface 68, a voucher information form 548 is displayed on the remote device 50A. The voucher information form 548 in the illustrated embodiment includes the voucher ID number, a good for field which identifies the product or service for which the voucher may be redeemed, an issued date, and an expiration date. Once the user 54 verifies the data displayed on the voucher information form, the user 54 may press the continue button to validate and except the voucher.

With specific reference to FIG. 27B, a method 550 for validating and processing and redeeming printed vouchers according to another embodiment of the present invention is shown. In a first step 552, a request form is displayed on the remote device 50A. The request form allows the user 54 to enter a voucher number or a voucher ID number. In one embodiment, the voucher ID number is entered manually. In another embodiment, the voucher number is read from the printed voucher. For example, the voucher ID number may be encoded into a bar code which is read by the bar code reader 66. In a second step 554, if the voucher ID number has been entered then the method proceeds to a third step 556. Otherwise, the method 550 proceeds to a fourth step 558 and an error message is displayed. In the third step 556, the voucher number is validated. In a fifth step 560, if the voucher number is valid, then the method proceeds to a sixth step 562. Otherwise, the method proceeds to the fourth step 558 and an error message is displayed. In the sixth step 562, if the voucher has already or previously been accepted, then the method 550 proceeds to the fourth method step 558 and an error message is displayed. Otherwise, the method 550 proceeds to a seventh method step 564 and the voucher is marked as accepted within the database 22.

M. Voucher Information Retrieval

Figure 29A:
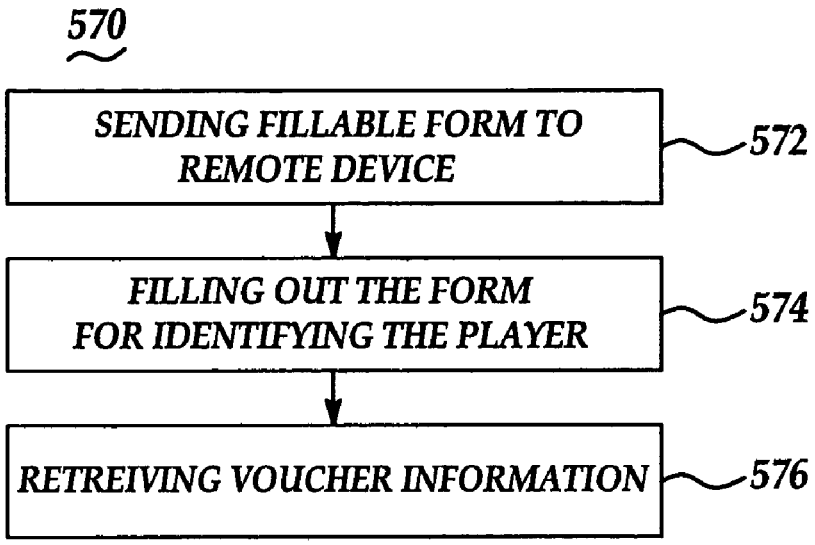
FIG. 29A is a first flow diagram of a method for displaying a list of outstanding vouchers for a selected player, according to a first embodiment of the present invention.
Figure 30:
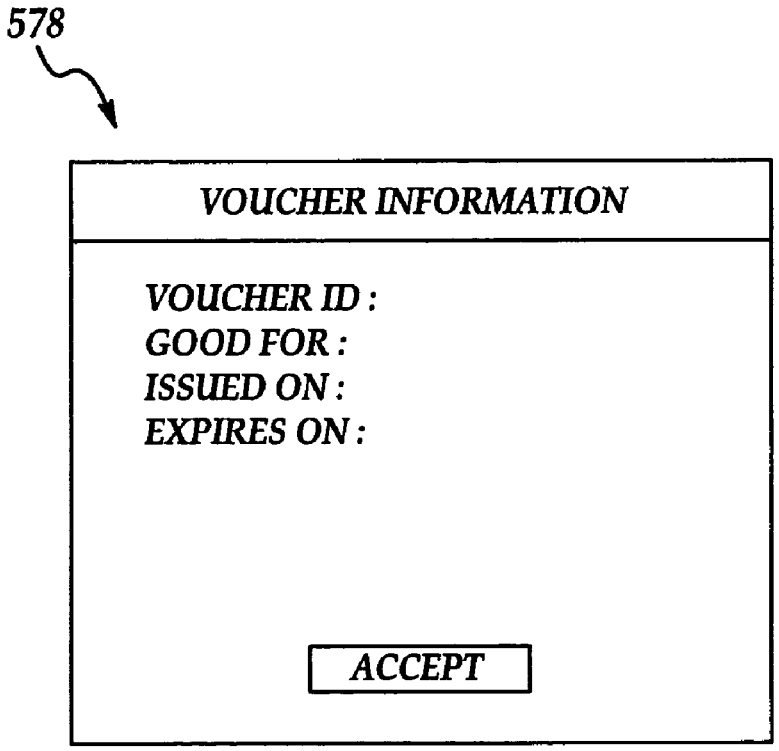
FIG. 30 is a diagrammatic illustration of a voucher information dialogue, according to an embodiment of the present invention.
Figure 29B:
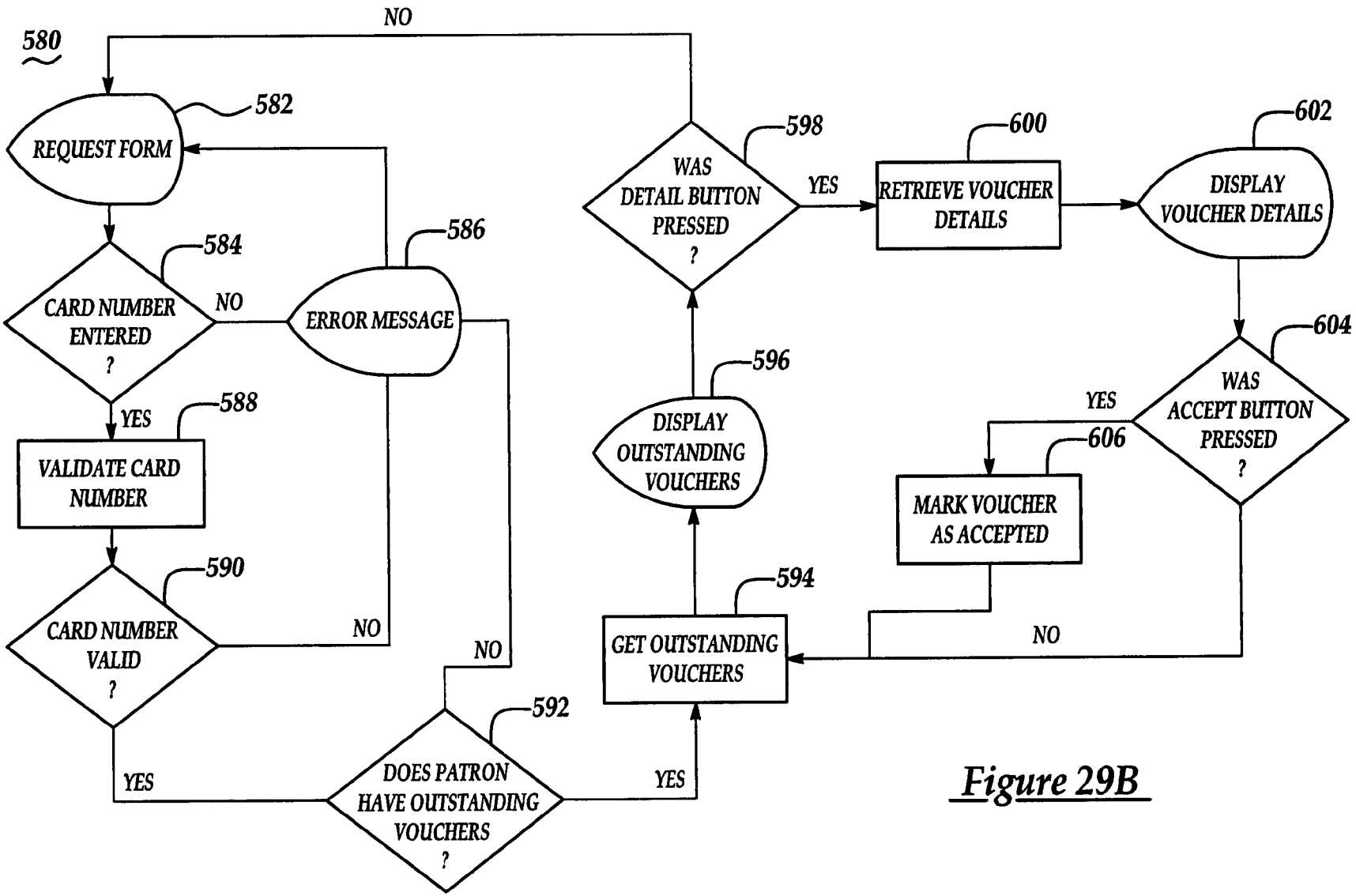
FIG. 29B is a second flow diagram of a method for displaying a list of outstanding vouchers for a selected patron, according to a second embodiment of the present invention.

With reference to FIGS. 29A, 29B and 30, the remote device 50A may be used to display a list of outstanding vouchers for a selected player or patron 24 and allow the user 54 to accept a specific voucher. Typically the voucher has an associated good, i.e., product, or service for which it may be redeemed. For example, a specific voucher may be redeemed for a free dinner and/or drink. In one embodiment, each voucher has a unique voucher ID number and is stored as a record in the database 22. In another embodiment, the voucher may be embodied in a printed ticket having the voucher ID printed or encoded thereon. The voucher ID number would be associated with the player 24 in the database 22.

In one aspect of the present invention, at least one voucher is assigned to the player 24 in the player tracking system. The voucher has at least one of the good and/or service for which it may be exchanged. The remote network interface 68 may be used for exchanging data between the host computer 18 and the remote device 50A. The data includes voucher information associated with the voucher assigned to the player 24 in the player tracking system.

In one embodiment, the data exchange between the remote device 50A and the remote network interface 68 includes a request form. The remote network interface 68 sends the request form to the remote device 50A. The request form may be used by the user 54 for entering information related to the player. The remote device 50A sends the player information to the remote interface 68. As discussed below, in one embodiment of the present invention, the player information includes the player ID card number. The player ID card number may be entered manually or may be read by the player ID card reader 62 or the bar code reader 66, as appropriate. The player ID card number is relayed to the remote network interface 68. The remote network interface 68 returns a list of outstanding vouchers associated with the player 24. The user 54 may view details related to each voucher. The user 54 may select one of the vouchers to accept, i.e., redeem for the associated service or good.

With specific reference to FIG. 29A, a first method 570 for redeeming outstanding vouchers for a selected player 24 is shown. In a first step 572, a fillable form is sent to the remote device 50A. In a second step 574, the form is filled out by the user 54 for identifying the player. In a third step 576, voucher information is retrieved through the remote network interface 68. As discussed above, once the player has been identified, a list of outstanding vouchers is returned to the remote device 50A. A details button (not shown) associated with each voucher in the list may be selected by the user 54 to display voucher information related to the selected voucher. For example, with reference to FIG. 30, an exemplary voucher information screen 578 is shown. The voucher information screen 578 may display the voucher ID number, the good or service for which it may be redeemed, the date it was issued, and the date the voucher expires. The voucher information screen 578 also includes an accept button which may be selected by the user to accept the voucher as it is redeemed.

With specific reference to FIG. 29B, second method 580 for displaying and redeeming outstanding vouchers associated with the player 24 is shown. In a first step 582, a request form is displayed on the remote device 50A. In one embodiment, the user 54 may enter a player ID card number on the request form. In one embodiment, the player ID card number is entered manually. In another embodiment, the player ID card number may be read from the player ID card by the ID card reader 62 or the bar code reader 66. In a second step 584, if an ID card number has been entered, then the method 580 proceeds to a third step 588. Otherwise, the method 580 proceeds to a fourth step 586 and an error message is displayed. In the third step 588, the ID card number is validated. In a fifth step 590, if the ID card number is not valid, then the method 580 proceeds to the third step 586 and an error message is displayed. Otherwise, the method proceeds to a sixth step 592.

In the sixth step 592, if the player 24 does not have any outstanding vouchers, then the method 580 proceeds to the fourth step 586 and an error message is displayed. Otherwise, the method 580 proceeds to a seventh step 594.

In the seventh step 594, any outstanding vouchers associated with the player 24 are retrieved from the database 22. In an eighth step 596, the retrieved outstanding vouchers are displayed on the remote device 50A. As discussed above, each voucher in the list has an associated detail button (not shown).

In a ninth step 598, if the detail button for one of the listed vouchers was pressed or selected, then the method 580 proceeds to a tenth step 600. Otherwise, the method 580 returns to the first step 592. In the tenth step 600, voucher details for the selected voucher are retrieved from the database 22. In eleventh step 602, the voucher details for the selected voucher are displayed on the remote device 50A. In a twelfth step 604, if the accept button for the selected voucher was pressed or selected, then the method 580 proceeds to a thirteenth step 606. Otherwise, the method 580 returns to the seventh step 594.

In the thirteenth step 606, the selected voucher is marked as being accepted and the method returns to the seventh step 594.

N. System Information

In another aspect of the present invention, the database 22 may store information related to the remote devices 50, including the current state of the remote device 50. As discussed below, this information may be retrieved and displayed on the remote device 50A, for example, for purposes of tech support. In one embodiment, the user 54 selects the servlet or applet from the menu layer 80. The remote network interface 68 produces an HTML form that displays the information related to the remote device 50 to the user 54.

In one embodiment, the data includes information which is associated with a current client being utilized on the remote device 50A. For example, the data may include but is not limited to a TCP/IP address of the current client. An HTTP context of the current client for the current session, an IOP ID of the current client as defined in the database 22 and an IOP name of the current client is defined in the database. IOP or input output point is a designator to represent a point of data input or output such as a dedicated terminal, hand held device, etc., that is distinguished usually by its IP address on the network. The IOP ID and name are used to tie transactions that are generated to a particular entity or device.

The data may also include information related to a current user 54 of the remote device 50. For example, the data may include an employee ID number and/or the employee name.

Obviously, many modifications and variations of the present invention are possible in light of the above teachings. The invention may be practiced otherwise than as specifically described within the scope of the appended claims.

What is claimed is:

1. A remote system for use with a gaming system, the gaming system for implementing a player tracking system, the remote system comprising:

a remote device embodied in a handheld computer which may be carried by a user; and, a host computer having a remote network interface coupled to the remote device via a wireless connection for exchanging data between a host computer and the remote device, the data including:

player identification information entered by the user on the remote device and sent to the host computer;

a list of vouchers for which the corresponding player has enough comp or bonus points to purchase to the remote device from the host computer;

a selected voucher sent entered by the user on the remote device and sent to the host computer; and voucher information to issue the selected voucher to the player in the player tracking system, the selected voucher having at least one of an associated product or service.

2. A remote system, as set forth in claim 1, wherein the selected voucher is:

a paper voucher printed on a remote printer carried by the user, and/or a pre-printed voucher having a voucher ID number which is assigned to the players, and/or an electronic voucher embodied in a record stored in a database.

3. A remote system, as set forth in claim 1, wherein the wireless connection uses an IEEE 802.11 standard.

4. A remote system, as set forth in claim 3, wherein the wireless connection is IEEE 802.11b.

5. A remote system, as set forth in claim 3, wherein the wireless connection is IEEE 802.11g.

6. A remote system, as set forth in claim 1, the remote device having a processor and a web client for interaction with a user.

7. A remote system, as set forth in claim 6, the web client for acquiring input from the user and formatting and presenting data to the user.

8. A remote system, as set forth in claim 1, the data including a request form, the remote network interface for sending the request form to the remote device.

9. A remote system, as set forth in claim 8, the data including player information, the request form being fillable with the player information by a user, the remote device for sending the player information to the remote network interface.

10. A remote system, as set forth in claim 9, the remote device having a processor and a web client for interaction with a user, the request form being accessible through the web client.

11. A remote system, as set forth in claim 1, the remote network interface for assigning the voucher to a voucher ID number associated with a printed voucher.

12. A remote system, as set forth in claim 1, wherein the voucher is stored as a record in a database.

13. A remote system, as set forth in claim 1, the host computer including a database for maintaining the player tracking system, the remote network interface coupled to the database for retrieving and storing data therein.

14. A remote system, as set forth in claim 13, the database for storing data in database tables.

15. A remote system, as set forth in claim 14, further comprising a plurality of first data object coupled to the database tables for retrieving and storing data in the database tables.

16. A remote system, as set forth in claim 15, further comprising at least one second data object coupled to the first data objects for assembling multiple first data objects into a third data object.

17. A remote system, as set forth in claim 16, the third data object coupled to the remote network interface for receiving queries from the remote network interface, retrieves responsive data from the database, formatting the responsive data and returning the responsive data to the remote network interface.

18. A remote system, as set forth in claim 17, the remote network interface for receiving the responsive data and transmitting the responsive data to the remote device.

19. A remote system, as set forth in claim 18, the remote device having a processor and a web client for interaction with a user, the remote network interface for formatting the responsive data into a hyper text mark-up language response for display by the web client.

20. A remote system, as set forth in claim 6, the web client including a plurality of servlets for providing functionality to a user.

21. A remote system, as set forth in claim 20, the web client including a login layer for identifying the user.

22. A remote system, as set forth in claim 21, the web client including a menu layer for allowing the user to navigate to and access the servlets.

23. A remote system, as set forth in claim 22, the user having an assigned type, the menu layer for allowing accessing to servlets and restricting access to servlets as a function of the assigned type.

24. A remote system, as set forth in claim 1, wherein the data includes a player ID card number.

25. A remote system, as set forth in claim 24, wherein the data includes a personal identification number.

26. A method for implementing a player tracking system for use with a gaming system, the method including the steps of:

providing a remote device embodied in a handheld computer which may be carried by a user;

providing a host computer coupled to the remote device via a wireless connection;

sending a fillable form to the remote device from the host computer over the wireless connection;

filling out the form with player identification information, by a user, on the remote device and sent to the host computer over the wireless connection;

sending a list of vouchers, for which the corresponding player has enough comp or bonus points to purchase, to the remote device from the host computer over the wireless connection;

sending a selected voucher entered by the user on the remote device and sent to the host computer over the wireless connection; and issuing the selected voucher to the player, the voucher having at least one of an associated service and product.

27. A method, as set forth in claim 26, wherein the selected voucher is:

a paper voucher printed on a remote printer carried by the user, and/or a pre-printed voucher having a voucher ID number which is assigned to the players, and/or an electronic voucher embodied in a record stored in a database.

28. A method, as set forth in claim 26, wherein the wireless connection uses an IEEE 802.11 standard.

29. A method, as set forth in claim 28, wherein the wireless connection is IEEE 802.11b.

30. A method, as set forth in claim 28, wherein the wireless connection is IEEE 802.11g.

31. A method, as set forth in claim 26, the remote device having a processor and a web client for interaction with a user, the method including the steps of:

acquiring input via the web client from the user; and, formatting and presenting data to the user.

32. A method, as set forth in claim 26, the data including a request form, the method including the step of sending the request form to the remote device.

33. A method, as set forth in claim 32, the data including player information, the request form being fillable with the player information by the user, the method including the step of sending the player information to a remote network interface located on a host computer.

34. A method, as set forth in claim 33, the request form being accessible through the web client.

35. A method, as set forth in claim 34, the method including the step of the confirming that all required information on the request form was entered and instructing a display on the remote display to display an error message if all required information was not entered.

36. A method, as set forth in claim 26, including the step of assigning the voucher to a voucher ID number associated with a printed voucher.

37. A method, as set forth in claim 26, including the step of storing the voucher as a record in a database.

38. A method, as set forth in claim 26, data related to the player tracking system being stored in a database stored on a host computer, the method including the step of providing a remote network interface coupled to the database for retrieving and storing data therein.

39. A method, as set forth in claim 38, the method including the step of the storing data in the database in database tables.

40. A method, as set forth in claim 39, the method including the step of providing a plurality of first data object coupled to the database tables for retrieving and storing data in the database tables.

41. A method, as set forth in claim 40, the method including the step of providing at least one second data object coupled to the first data objects for assembling multiple first data objects into a third data object.

42. A method, as set forth in claim 41, the third object being coupled to the remote network interface, the method including the steps of receiving, by the third object, queries from the remote network interface, retrieving responsive data from the database, formatting the responsive data and returning the responsive data to the remote network interface.

43. A method, as set forth in claim 38, the method including the step of receiving, by the remote network interface, the responsive data and transmitting the responsive data to the remote device.

44. A method, as set forth in claim 43, the remote device having a processor and a web client for interaction with a user, the method including the steps of formatting, by the remote network interface, the responsive data into a hyper text mark-up language response for display by the web client.

45. A method, as set forth in claim 31, the web client including a plurality of servlets for providing functionality to a user.

46. A method, as set forth in claim 45, the web client including a login layer for identifying the user.

47. A method, as set forth in claim 46, the web client including a menu layer for allowing the user to navigate to and access the servlets.

48. A method, as set forth in claim 47, the user having an assigned type, the menu layer for allowing accessing to servlets and restricting access to servlets as a function of the assigned type.

49. A method, as set forth in claim 26, wherein the data includes a player ID card number.

* * * * *